US011497972B2

(12) United States Patent
Hill et al.

(10) Patent No.: US 11,497,972 B2
(45) Date of Patent: Nov. 15, 2022

(54) IRON GOLF CLUB HEAD

(71) Applicant: Taylor Made Golf Company, Inc, Carlsbad, CA (US)

(72) Inventors: Brian Hill, Carlsbad, CA (US); Bret H. Wahl, Escondido, CA (US); Scott Taylor, Bonita, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

(21) Appl. No.: 17/110,112

(22) Filed: Dec. 2, 2020

(65) Prior Publication Data

US 2021/0146206 A1 May 20, 2021

Related U.S. Application Data

(63) Continuation of application No. 16/525,284, filed on Jul. 29, 2019, now Pat. No. 10,881,926.

(51) Int. Cl.
*A63B 53/04* (2015.01)

(52) U.S. Cl.
CPC ..... *A63B 53/0475* (2013.01); *A63B 53/042* (2020.08); *A63B 53/0462* (2020.08); *A63B 2053/0491* (2013.01)

(58) Field of Classification Search
CPC ..... A63B 53/0462; A63B 53/047; A63B 53/0475
USPC ..... 473/324–350
See application file for complete search history.

(56) References Cited

U.S. PATENT DOCUMENTS

| | | | |
|---|---|---|---|
| D115,217 | S | 6/1939 | Newsome |
| D125,455 | S | 2/1941 | Newsome |
| D137,813 | S | 5/1944 | Newsome |
| D137,814 | S | 5/1944 | Newsome |
| D137,815 | S | 5/1944 | Newsome |
| D137,816 | S | 5/1944 | Newsome |
| D141,307 | S | 5/1945 | Newsome |

(Continued)

FOREIGN PATENT DOCUMENTS

| | | |
|---|---|---|
| JP | 2003183758 | 7/2003 |
| JP | 2005118157 | 5/2005 |

(Continued)

OTHER PUBLICATIONS

U.S. Appl. No. 16/434,162, filed Jun. 6, 2019.
U.S. Appl. No. 16/160,974, filed Oct. 15, 2018.
U.S. Appl. No. 16/160,884, filed Oct. 15, 2018.

*Primary Examiner* — Alvin A Hunter
(74) *Attorney, Agent, or Firm* — Kunzler Bean & Adamson

(57) ABSTRACT

Disclosed herein is an iron-type golf club head. The iron-type golf club head comprises a body, having a density of less than 8 grams-per-cubic-centimeter (g/cc). The body comprises a heel portion, a toe portion, a sole portion, a top portion, and a front portion. The body also comprises a rear portion, comprising an insert shelf, adjacent the sole portion and extending from the toe portion to the heel portion, and a retention bar, integrally formed with a portion of the insert shelf and circumferentially closing the portion of the insert shelf to define a first insert channel. The iron-type golf club head also comprises a high-density insert, having a density of greater than 7.5 g/cc, supported by the insert shelf, and retained within the first insert channel by the retention bar.

19 Claims, 12 Drawing Sheets

(56) References Cited

U.S. PATENT DOCUMENTS 3,961,796 A 6/1976 Thompson
4,793,616 A 12/1988 Fernandez
4,852,880 A 8/1989 Kobayashi
5,312,106 A 5/1994 Cook
5,388,826 A 2/1995 Sherwood
5,439,223 A 8/1995 Kobayashi
D362,885 S 10/1995 Blough et al.
D362,887 S 10/1995 Blough et al.
5,584,770 A 12/1996 Jensen
5,613,917 A 1/1997 Kobayashi et al.
5,599,243 A 2/1997 Kobayashi
5,669,826 A 9/1997 Cheng et al.
5,766,091 A 6/1998 Humphrey et al.
D397,180 S 8/1998 Takahashi et al.
D397,388 S 8/1998 Nelson
D399,277 S 10/1998 Ezaki
D400,943 S 11/1998 Ezaki
D401,637 S 11/1998 Best et al.
5,833,551 A 11/1998 Vincent et al.
5,899,821 A * 5/1999 Hsu ..... A63B 53/04 473/332
6,015,354 A 1/2000 Ahn et al.
D420,080 S 2/2000 Gates et al.
6,027,415 A 2/2000 Takeda et al.
6,030,293 A * 2/2000 Takeda ..... A63B 60/00 473/334
6,030,295 A * 2/2000 Takeda ..... A63B 60/00 473/345
6,080,069 A 6/2000 Long et al.
D428,634 S 7/2000 Nagai et al.
D428,635 S 7/2000 Nagai et al.
D432,611 S 10/2000 McCabe et al.
D434,462 S 11/2000 Reed et al.
D435,278 S 12/2000 Reed et al.
D435,617 S 12/2000 Gilbert
D437,906 S 2/2001 Gilbert et al.
D441,821 S 5/2001 Turner
D446,566 S 8/2001 McCabe et al.
D449,086 S 10/2001 Nagai et al.
D454,932 S 3/2002 Mahaffey et al.
6,440,010 B1 8/2002 Deshmukh
D465,253 S 11/2002 Best
D466,576 S 12/2002 Nagai et al.
D469,140 S 1/2003 Best
D469,832 S 2/2003 Bode et al.
D473,606 S 4/2003 Mickelson et al.
D473,904 S 4/2003 Llewellyn et al.
D475,107 S 5/2003 Madore et al.
D479,568 S 9/2003 Rodgers et al.
6,638,183 B2 10/2003 Takeda
D486,543 S 2/2004 Gilbert et al.
D487,127 S 2/2004 Madore
D491,620 S 6/2004 Nishitani
D492,376 S 6/2004 Nicolette et al.
6,811,496 B2 11/2004 Wahl et al.
D499,779 S 12/2004 Mahaffey et al.
6,929,563 B2 8/2005 Nishitani et al.
D509,868 S 9/2005 Imamoto
6,942,580 B2 * 9/2005 Hou ..... A63B 53/047 473/332
D516,650 S 3/2006 Wolfe et al.
D517,626 S 3/2006 Gilbert et al.
D519,179 S 4/2006 Roberts et al.
7,022,028 B2 4/2006 Nagai et al.
D523,917 S 6/2006 Wolfe et al.
D526,037 S 8/2006 Kelley
D526,038 S 8/2006 Kelley
7,083,531 B2 8/2006 Aguinaldo et al.
7,112,148 B2 9/2006 Deshmukh
D534,609 S 1/2007 Gilbert et al.
D536,759 S 2/2007 Schweigert et al.
D540,901 S 4/2007 Gilbert et al.
D541,363 S 4/2007 Gilbert et al.
D549,797 S 8/2007 Oldknow
D550,317 S 9/2007 Oldknow
D550,796 S 9/2007 Nagai et al.
7,303,489 B2 * 12/2007 Gilbert ..... A63B 53/0475 473/350
D559,931 S 1/2008 Roach et al.
7,316,623 B2 * 1/2008 Imamoto ..... A63B 53/047 473/332
D561,855 S 2/2008 Schweigert et al.
7,338,387 B2 3/2008 Nycum et al.
D566,803 S 4/2008 Foster et al.
D571,881 S 6/2008 Nicolette et al.
D572,326 S 7/2008 Schweigert et al.
D572,327 S 7/2008 Diaz et al.
D572,328 S 7/2008 Diaz et al.
D572,788 S 7/2008 Diaz et al.
D579,996 S 11/2008 Gilbert et al.
D584,370 S 1/2009 Cleveland et al.
D597,158 S 7/2009 Schweiger et al.
D597,617 S 8/2009 Ines et al.
D597,618 S 8/2009 Ines et al.
D598,060 S 8/2009 Barez et al.
D601,215 S 9/2009 Diaz et al.
D601,216 S 9/2009 Jertson et al.
7,588,503 B2 9/2009 Roach et al.
D602,103 S 10/2009 Jorgensen
D606,606 S 12/2009 Llewellyn et al.
7,662,051 B2 * 2/2010 Chen ..... A63B 53/047 473/342
D618,293 S 6/2010 Foster et al.
D619,183 S 7/2010 Llewellyn et al.
D619,184 S 7/2010 Llewellyn et al.
D619,667 S 7/2010 Cleveland
D631,110 S 1/2011 Kim et al.
7,922,604 B2 4/2011 Roach et al.
7,938,739 B2 5/2011 Cole et al.
D643,488 S 8/2011 Holt et al.
D643,895 S 8/2011 Wieland
8,088,023 B2 1/2012 Kubota
8,088,025 B2 * 1/2012 Wahl ..... A63B 60/00 473/346
8,182,362 B2 5/2012 Kusumoto et al.
8,182,364 B2 5/2012 Cole et al.
8,206,237 B2 6/2012 Gilbert et al.
8,257,198 B2 9/2012 Gilbert et al.
D672,417 S 12/2012 Jertson et al.
8,328,663 B2 12/2012 Wahl et al.
8,454,453 B2 6/2013 Hettinger et al.
8,475,293 B2 * 7/2013 Morin ..... A63B 53/047 473/329
8,535,176 B2 * 9/2013 Bazzel ..... A63B 53/047 473/345
8,535,177 B1 9/2013 Wahl et al.
8,574,094 B2 11/2013 Nicolette et al.
8,632,416 B2 1/2014 Finn et al.
8,740,721 B2 6/2014 Yamamoto
8,758,163 B2 6/2014 Stites
8,845,450 B2 9/2014 Beach et al.
D716,391 S 10/2014 Roche et al.
8,858,364 B2 10/2014 Deng et al.
8,870,683 B2 10/2014 Hettinger et al.
D720,026 S 12/2014 Llewellyn et al.
8,911,302 B1 12/2014 Ivanova et al.
8,974,317 B1 * 3/2015 Griffin ..... A63B 53/0475 473/290
9,033,819 B2 5/2015 Wahl et al.
9,044,653 B2 6/2015 Wahl et al.
9,138,622 B1 * 9/2015 DeMille ..... A63B 53/0475
9,174,096 B2 11/2015 Sargent et al.
9,211,451 B1 12/2015 Westrum et al.
D746,926 S 1/2016 Parsons
D754,806 S 4/2016 Bacon
9,352,198 B2 5/2016 Roach et al.
D760,333 S 6/2016 Harrington
D762,794 S 8/2016 Wieland
D763,375 S 8/2016 Chun
D764,610 S 8/2016 Parsons
9,427,635 B2 8/2016 Ines et al.
D765,803 S 9/2016 Dliveiro
D765,804 S 9/2016 Dliveiro
D776,772 S 1/2017 Foster et al.

(56) References Cited

U.S. PATENT DOCUMENTS

| | | | | |
|---|---|---|---|---|
| 9,597,562 | B2 * | 3/2017 | Dipert | A63B 60/00 |
| D788,863 | S | 6/2017 | Honea | |
| 9,731,176 | B2 | 8/2017 | Issertell et al. | |
| D796,606 | S | 9/2017 | Oliveiro | |
| D797,223 | S | 9/2017 | Kitching et al. | |
| D797,224 | S | 9/2017 | Oliveiro | |
| 9,750,993 | B2 | 9/2017 | Ritchie et al. | |
| D806,813 | S | 1/2018 | Son et al. | |
| D815,704 | S | 4/2018 | Clarke et al. | |
| 9,975,018 | B2 | 5/2018 | Dipert et al. | |
| 10,004,957 | B2 | 6/2018 | Franz et al. | |
| 10,022,601 | B2 | 7/2018 | Petersen et al. | |
| 10,052,534 | B1 | 8/2018 | Ines | |
| 10,105,581 | B2 | 10/2018 | Abe et al. | |
| D832,952 | S | 11/2018 | Milleman et al. | |
| D832,953 | S | 11/2018 | Bacon et al. | |
| 10,137,338 | B2 | 11/2018 | Nakamura et al. | |
| D835,735 | S | 12/2018 | Chun et al. | |
| 10,220,272 | B2 * | 3/2019 | Gonzalez | A63B 53/0475 |
| 10,398,951 | B2 | 9/2019 | Golden et al. | |
| 10,423,945 | B2 | 9/2019 | Long et al. | |
| 10,427,014 | B2 | 10/2019 | Taylor et al. | |
| 10,625,126 | B2 * | 4/2020 | Demkowski | A63B 53/047 |
| 10,729,950 | B2 * | 8/2020 | Gonzalez | A63B 53/0475 |
| 10,881,926 | B1 * | 1/2021 | Hill | A63B 53/04 |
| 2007/0155534 | A1 | 7/2007 | Tsai et al. | |
| 2007/0281796 | A1 | 12/2007 | Gilbert et al. | |
| 2013/0324280 | A1 | 12/2013 | Boyd et al. | |
| 2015/0273287 | A1 | 10/2015 | Doi et al. | |
| 2015/0352412 | A1 | 12/2015 | Narita et al. | |
| 2016/0346638 | A1 | 12/2016 | Snyder | |
| 2018/0185717 | A1 | 7/2018 | Demkowski et al. | |

FOREIGN PATENT DOCUMENTS

| | | |
|---|---|---|
| JP | 2007319687 | 12/2007 |
| JP | 2008183362 | 8/2008 |
| JP | 2009034553 | 2/2009 |
| JP | 2009066071 | 4/2009 |
| JP | 2009261930 | 11/2009 |
| JP | 2009291488 | 12/2009 |
| JP | 2010029380 | 2/2010 |
| JP | 2010142448 | 7/2010 |
| JP | 2011004810 | 1/2011 |
| JP | 2012105821 | 6/2012 |
| JP | 2014004367 | 1/2014 |
| JP | 5406467 | 2/2014 |
| JP | 2014018309 | 2/2014 |
| JP | 2015000237 | 1/2015 |
| JP | 2015027373 | 2/2015 |
| JP | 2015128580 | 7/2015 |
| JP | 2016007443 | 1/2016 |
| JP | 2016010579 | 1/2016 |
| JP | 2016086905 | 5/2016 |
| JP | 2016120176 | 7/2016 |
| JP | 2016120264 | 7/2016 |
| JP | 2016221181 | 12/2016 |
| JP | 2017000399 | 1/2017 |
| JP | 2017029346 | 2/2017 |
| JP | 2017189293 | 10/2017 |
| JP | 2017196234 | 11/2017 |
| JP | 2018000471 | 1/2018 |
| JP | 2018134464 | 8/2018 |
| WO | 2008102501 | 5/2010 |

* cited by examiner

IRON GOLF CLUB HEAD

CROSS-REFERENCE TO RELATED APPLICATIONS

This application references U.S. patent application Ser. No. 15/394,549, filed Dec. 29, 2016, and U.S. patent application Ser. No. 15/706,632, filed Sep. 15, 2017, which is a continuation-in-part of patent application Ser. No. 15/394,549, both of which are incorporated by reference herein in their entireties. This application also references U.S. Pat. No. 9,044,653, filed Mar. 14, 2013, which claims the benefit of U.S. Provisional Patent Application No. 61/657,675, filed Jun. 8, 2012, both of which are hereby incorporated by reference herein in their entireties. This application further references U.S. Pat. No. 8,353,785, filed Apr. 19, 2010, which claims the benefit of U.S. Provisional Patent Application No. 61/214,487, filed Apr. 23, 2009, both of which are hereby incorporated by reference herein in their entireties. This application also references U.S. Pat. No. 6,811,496, filed Sep. 3, 2002, which is hereby incorporated by reference in its entirety. This application additionally references U.S. patent application Ser. No. 13/111,715, filed May 19, 2011, which is incorporated herein by reference in its entirety. This application further references U.S. patent application Ser. No. 14/981,330, filed Dec. 28, 2015, which claims the benefit of U.S. Provisional Patent Application No. 62/099,012, filed Dec. 31, 2014, and U.S. Provisional Patent Application No. 62/098,707, filed Dec. 31, 2014, all of which are incorporated herein by reference in their entirety. This application claims the benefit of U.S. Provisional Patent Application No. 62/846,492, filed May 10, 2019, which is incorporated herein by reference in its entirety.

FIELD

This disclosure relates generally to golf clubs, and more particularly to a golf club head with a strike plate that is separately attached to a body of the golf club head.

BACKGROUND

The performance of golf equipment is continuously advancing due to the development of innovative clubs and club designs. While all clubs in a golfer's bag are important, both scratch and novice golfers rely on the performance and feel of their irons for many commonly encountered playing situations.

Advancements in golf club head manufacturing techniques have facilitated the manufacturing of golf club heads with advanced geometries, configurations, and materials. Many performance considerations affect the design and material properties of a golf club head. However, in some instances, one performance characteristic may be sacrificed for another performance characteristic based on the design and or material selected for the golf club head. Making a golf club head that utilizes advances geometries, configurations, and materials without significantly negatively impacting performance characteristics can be difficult.

SUMMARY

The subject matter of the present application has been developed in response to the present state of the art, and in particular, in response to the shortcomings of golf clubs and associated golf club heads, that have not yet been fully solved by currently available techniques. Accordingly, the subject matter of the present application has been developed to provide a golf club and golf club head that overcome at least some of the above-discussed shortcomings of prior art techniques.

Disclosed herein is an iron-type golf club head. The iron-type golf club head comprises a body, having a density of less than 8 grams-per-cubic-centimeter (g/cc). The body comprises a heel portion, a toe portion, a sole portion, a top portion, and a front portion, comprising a strike face. The body also comprises a rear portion, comprising an insert shelf, adjacent the sole portion and extending from the toe portion to the heel portion, and a retention bar, integrally formed with a portion of the insert shelf and circumferentially closing the portion of the insert shelf to define a first insert channel. The iron-type golf club head also comprises a high-density insert, having a density of greater than 7.5 g/cc, supported by the insert shelf, and retained within the first insert channel by the retention bar. The preceding subject matter of this paragraph characterizes example 1 of the present disclosure.

The iron-type golf club head further comprises an internal cavity enclosed by the heel portion, the toe portion, the sole portion, the top portion, the front portion, and the rear portion. The preceding subject matter of this paragraph characterizes example 2 of the present disclosure, wherein example 2 also includes the subject matter according to example 1, above.

The high-density insert is external to the internal cavity. The preceding subject matter of this paragraph characterizes example 3 of the present disclosure, wherein example 3 also includes the subject matter according to example 2, above.

The internal cavity is filled with a filler material. The preceding subject matter of this paragraph characterizes example 4 of the present disclosure, wherein example 4 also includes the subject matter according to any one of examples 2-3, above.

The filler material is a foam. The preceding subject matter of this paragraph characterizes example 5 of the present disclosure, wherein example 5 also includes the subject matter according to example 4, above.

The high-density insert is made of a material having a density of at least 16.7 g/cc. The preceding subject matter of this paragraph characterizes example 6 of the present disclosure, wherein example 6 also includes the subject matter according to any one of examples 1-5, above.

The high-density insert is made of a tungsten alloy. The preceding subject matter of this paragraph characterizes example 7 of the present disclosure, wherein example 7 also includes the subject matter according to example 6, above.

The high-density insert is asymmetric. The preceding subject matter of this paragraph characterizes example 8 of the present disclosure, wherein example 8 also includes the subject matter according to any one of examples 1-7, above.

A mass of the high-density insert at a toe end of the high-density insert is greater than at a heel end of the high-density insert. The preceding subject matter of this paragraph characterizes example 9 of the present disclosure, wherein example 9 also includes the subject matter according to example 8, above.

The heel portion, the toe portion, the sole portion, the top portion, the front portion, and at least a portion of the rear portion are made of a titanium alloy. The preceding subject matter of this paragraph characterizes example 10 of the present disclosure, wherein example 10 also includes the subject matter according to any one of examples 1-9, above.

The high-density insert defines an exterior surface of the iron-type golf club head. The preceding subject matter of this paragraph characterizes example 11 of the present disclosure, wherein example 11 also includes the subject matter according to any one of examples 1-10, above.

The high-density insert defines an exterior surface of the iron-type golf club head at the rear portion and the toe portion of the iron-type golf club head. The preceding subject matter of this paragraph characterizes example 12 of the present disclosure, wherein example 12 also includes the subject matter according to example 11, above.

The rear portion further comprises a retention flap, spaced apart from the insert shelf and from the retention bar. The retention flap at least partially circumferentially closes the insert shelf to define a second insert channel. The high-density insert is retained within the second insert channel by the retention flap. The preceding subject matter of this paragraph characterizes example 13 of the present disclosure, wherein example 13 also includes the subject matter according to any one of examples 1-12, above.

The rear portion further comprises a rear wall. The insert shelf, the retention bar, and the retention flap, and the rear wall form a one-piece monolithic construction with the heel portion, the toe portion, the sole portion, and the top portion. The preceding subject matter of this paragraph characterizes example 14 of the present disclosure, wherein example 14 also includes the subject matter according to example 13, above.

The front portion further comprises a face opening and a strike plate coupled to and enclosing the face opening. The strike plate defines at least a portion of the strike face. The preceding subject matter of this paragraph characterizes example 15 of the present disclosure, wherein example 15 also includes the subject matter according to example 14, above.

The rear portion further comprises a rear opening. The rear portion also comprises a rear panel coupled to and enclosing the rear opening. The rear portion additionally comprises a retention flap, integrally formed in the rear panel, spaced apart from the insert shelf and from the retention bar, and at least partially circumferentially closing the insert shelf to define a second insert channel. The high-density insert is retained within the second insert channel by the retention flap. The preceding subject matter of this paragraph characterizes example 16 of the present disclosure, wherein example 16 also includes the subject matter according to any one of examples 1-13, above.

The heel portion, the toe portion, the sole portion, the top portion, the front portion, the insert shelf, and the retention bar are made of a first material. The rear panel is made of a second material. The second material is different than the first material. The preceding subject matter of this paragraph characterizes example 17 of the present disclosure, wherein example 17 also includes the subject matter according to example 16, above.

The first material has a density lower than the density of the high-density insert. The second material has a density greater than 1 g/cc and no more than the density of the first material. The second material is different than the first material. The preceding subject matter of this paragraph characterizes example 18 of the present disclosure, wherein example 18 also includes the subject matter according to example 17, above.

The first material comprises a titanium alloy. The high-density insert is made of a tungsten alloy. The second material comprises one of a titanium alloy, an aluminum alloy, or a polymer. The preceding subject matter of this paragraph characterizes example 19 of the present disclosure, wherein example 19 also includes the subject matter according to example 18, above.

The high-density insert is elongated. A length of the high-density insert is substantially parallel to the strike face. The high-density insert tapers toward the heel portion. The preceding subject matter of this paragraph characterizes example 20 of the present disclosure, wherein example 20 also includes the subject matter according to any one of examples 1-19, above.

A perimeter of the high-density insert at a toe end of the high-density insert is greater than at a heel end of the high-density insert. The preceding subject matter of this paragraph characterizes example 21 of the present disclosure, wherein example 21 also includes the subject matter according to example 20, above.

An entire length of the high-density insert is greater than an entire length of the strike face of the body. The preceding subject matter of this paragraph characterizes example 22 of the present disclosure, wherein example 22 also includes the subject matter according to any one of examples 1-21, above.

A center of gravity of the iron-type golf club head is no more than between 11 mm and 21 mm from a ground plane when the iron-type golf club head is at a proper address position on the ground plane. The preceding subject matter of this paragraph characterizes example 23 of the present disclosure, wherein example 23 also includes the subject matter according to any one of examples 1-22, above.

The iron-type golf club head has coefficient of restitution (COR) change value of at least −0.025, the COR change value being defined as a difference between a measured COR value of the iron-type golf club head and a United States Golf Association (USGA)-governed calibration plate COR value. The preceding subject matter of this paragraph characterizes example 24 of the present disclosure, wherein example 24 also includes the subject matter according to any one of examples 1-23, above.

The sole portion comprises a sole slot. The front portion further comprises an undercut feature that partially defines the sole slot. The preceding subject matter of this paragraph characterizes example 25 of the present disclosure, wherein example 25 also includes the subject matter according to any one of examples 1-24, above.

The retention bar constrains movement of the high-density insert in a front-to-rear direction. The preceding subject matter of this paragraph characterizes example 26 of the present disclosure, wherein example 26 also includes the subject matter according to any one of examples 1-25, above.

Further disclosed herein is an iron-type golf club head. The iron-type golf club head comprises a hosel. The iron-type golf club head also comprises a body, integrally formed with the hosel, made of a titanium alloy, and comprising a front portion, having a strike face, a sole portion, and a rear portion, opposite the front portion. The iron-type golf club head further comprises a high-density insert made of a tungsten alloy and coupled to an exterior of the rear portion of the body. A thickness of the front portion, defining the strike face, is between 2.2 mm and 3.6 mm. The iron-type golf club head has coefficient of restitution (COR) change value of at least −0.025, the COR change value being defined as a difference between a measured COR value of the iron-type golf club head and a United States Golf Association (USGA)-governed calibration plate COR value. A center of gravity of the iron-type golf club head is no more than between 11 mm and 21 mm from a ground plane when the iron-type golf club head is at a proper address position on the ground plane. A blade length LB is less than or equal to 82 mm and an overall width of the sole portion is less than or equal to 25.5 mm. The strike face comprises a leading edge. An offset between the hosel and the leading edge of the strike face is less than or equal to 4.5 mm. The preceding subject matter of this paragraph characterizes example 27 of the present disclosure.

The iron-type golf club head further comprises an enclosed interior cavity. The preceding subject matter of this paragraph characterizes example 28 of the present disclosure, wherein example 28 also includes the subject matter according to example 27, above.

The high-density insert has a mass of at least 80 grams. The preceding subject matter of this paragraph characterizes example 29 of the present disclosure, wherein example 29 also includes the subject matter according to any one of examples 27-28, above.

A mass of the high-density insert is at least 30% (e.g., at least 38%, between 35% and 50% or between 39% and 46%) of a total mass of the iron-type golf club head. The preceding subject matter of this paragraph characterizes example 30 of the present disclosure, wherein example 30 also includes the subject matter according to any one of examples 27-29, above.

The high-density insert has an overall length of at least 64 mm (e.g., at least 70 mm) or an overall length that is between 90% and 110% of a blade length of the body. The preceding subject matter of this paragraph characterizes example 31 of the present disclosure, wherein example 31 also includes the subject matter according to any one of examples 27-30, above.

The body further comprises a toe portion and a heel portion. The high-density insert is more massive nearer the toe portion than the heel portion. The preceding subject matter of this paragraph characterizes example 32 of the present disclosure, wherein example 32 also includes the subject matter according to any one of examples 27-31, above.

The high-density insert defines an exterior surface of the iron-type golf club head at the rear portion and the toe portion of the iron-type golf club head. The preceding subject matter of this paragraph characterizes example 33 of the present disclosure, wherein example 33 also includes the subject matter according to any one of examples 27-32, above.

The body further comprises a heel portion and a toe portion. The rear portion comprises an insert shelf, adjacent the sole portion and extending from the toe portion to the heel portion, and a retention bar, integrally formed with a portion of the insert shelf and circumferentially closing the portion of the insert shelf to define a first insert channel. The high-density insert is supported by the insert shelf and retained within the first insert channel by the retention bar. The preceding subject matter of this paragraph characterizes example 34 of the present disclosure, wherein example 34 also includes the subject matter according to any one of examples 27-33, above.

The rear portion further comprises a retention flap, spaced apart from the insert shelf and from the retention bar. The retention flap at least partially circumferentially closes the insert shelf to define a second insert channel. The high-density insert is retained within the second insert channel by the retention flap. The preceding subject matter of this paragraph characterizes example 35 of the present disclosure, wherein example 35 also includes the subject matter according to example 34, above.

Additionally disclosed herein is a method of making an iron-type golf club head. The method comprises enclosing a hollow internal cavity of the golf club head. the golf club head comprises a heel portion, a toe portion, a sole portion, a top portion, a front portion comprising a strike face, and a rear portion. The method also comprises after enclosing the hollow internal cavity of the golf club head, inserting a high-density insert along an insert shelf and through a first insert channel and a second insert channel, spaced apart from the first insert channel, in a toe-to-heel direction. The insert shelf, the first insert channel, and the second insert channel are external to the hollow internal cavity. The preceding subject matter of this paragraph characterizes example 36 of the present disclosure.

The high-density insert is asymmetrical and elongated along a length of the high-density insert. The length of the high-density insert is parallel to the toe-to-heel direction as the high-density insert is inserted in the toe-to-heel direction along the insert shelf and through the first insert channel and the second insert channel. The preceding subject matter of this paragraph characterizes example 37 of the present disclosure, wherein example 37 also includes the subject matter according to example 36, above.

Also disclosed herein is an iron-type golf club head comprising a body having an density of less than 8 grams-per-cubic-centimeter (g/cc). The body also comprises a heel portion, a toe portion, a sole portion, a top portion, a front portion, comprising a strike face, and a rear portion. The rear portion comprises a first retention bar located at a toeward position and a second retention bar located at a heelward position. The iron-type golf club head also comprises a high-density insert, having a density of greater than 7.5 g/cc, coupled to the rear portion of the body, and restrained from movement in a front-to-rear direction by the first retention bar and the second retention bar. The high-density insert defines a first exterior surface of the iron-type golf club head at the toe portion of the body and a second exterior surface of the iron-type golf club head at the rear portion of the body. The first exterior surface and the second exterior surface are separated by the first retention bar and the first retention bar defines a third exterior surface of the iron-type golf club head. The preceding subject matter of this paragraph characterizes example 38 of the present disclosure.

The high-density insert has a variable mass per unit length that varies in a heel-to-toe direction. A toe portion of the high-density insert has a greater mass per unit length than a central portion of the high-density insert. The toe portion of the high-density is located at least 20 mm toeward of a geometric center of the strike face. The central portion is located within 20 mm of the geometric center of the strike face. The preceding subject matter of this paragraph characterizes example 39 of the present disclosure, wherein example 39 also includes the subject matter according to example 38, above.

The high-density insert is tapered. The preceding subject matter of this paragraph characterizes example 40 of the present disclosure, wherein example 40 also includes the subject matter according to example 39, above.

The high-density insert has a variable density. The toe portion of the high-density insert has a greater density than the central portion of the high-density insert. The preceding subject matter of this paragraph characterizes example 41 of the present disclosure, wherein example 41 also includes the subject matter according to any one of examples 39 or 40, above.

A surface area of a total exterior surface of the iron-type golf club head defined by the high-density insert is at least 150 mm^2. The preceding subject matter of this paragraph characterizes example 42 of the present disclosure, wherein example 42 also includes the subject matter according to any one of examples 39-41, above.

A surface area of the first exterior surface of the iron-type golf club head defined by the high-density insert is at least 50 mm^2. The preceding subject matter of this paragraph characterizes example 43 of the present disclosure, wherein example 43 also includes the subject matter according to example 42, above.

The high-density insert is coupled to the rear portion of the body by slidably installing the high-density insert into place in a generally toe-to-heel direction. The preceding subject matter of this paragraph characterizes example 44 of the present disclosure, wherein example 44 also includes the subject matter according to any one of examples 42 or 43, above.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other instances, additional features and advantages may be recognized in certain examples and/or implementations that may not be present in all examples or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings depict only typical examples of the subject matter and are not therefore to be considered to be limiting of its scope, the subject matter will be described and explained with additional specificity and detail through the use of the drawings, in which.

DETAILED DESCRIPTION

The following describes examples of golf club heads in the context of an iron-type golf club, but the principles, methods and designs described may be applicable in whole or in part to utility golf clubs (also known as hybrid golf clubs), metal-wood-type golf club, driver-type golf clubs, putter-type golf clubs, and the like.

U.S. Patent Application Publication No. 2014/0302946 A1 ('946 App), published Oct. 9, 2014, which is incorporated herein by reference in its entirety, describes a "reference position" similar to the address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the club head in the reference position.

Figure 4:
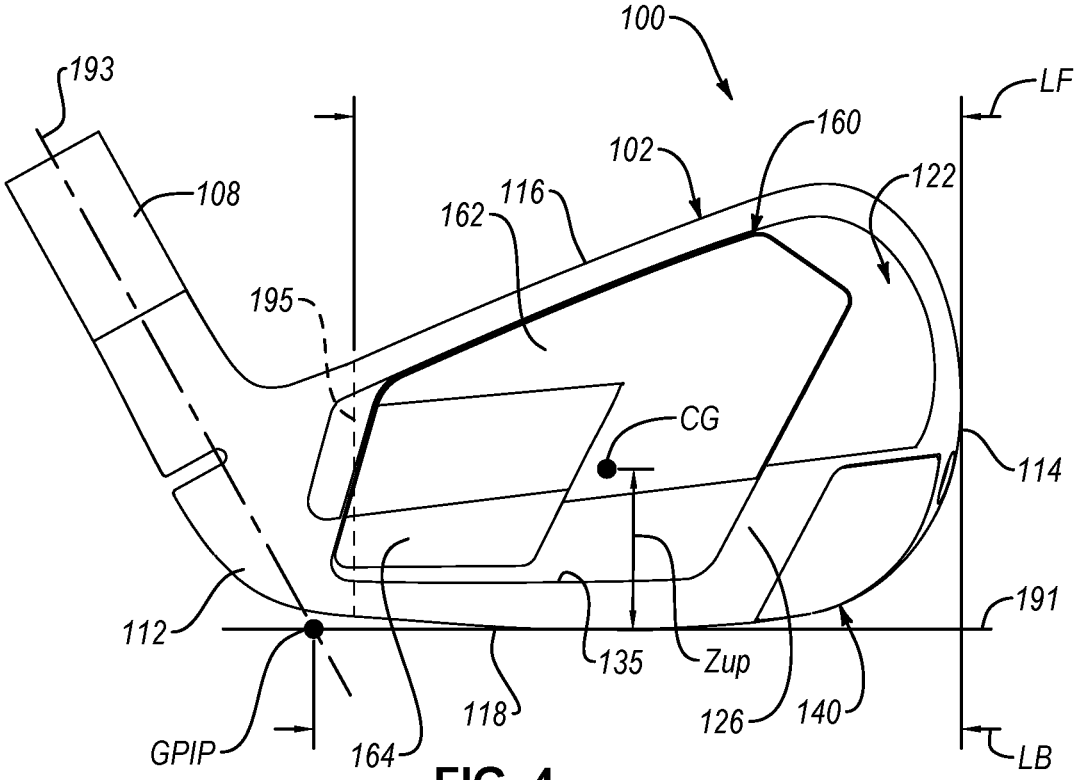
FIG. 4 is a rear view of the golf club head of FIG. 1, according to one or more examples of the present disclosure.
Figure 5:
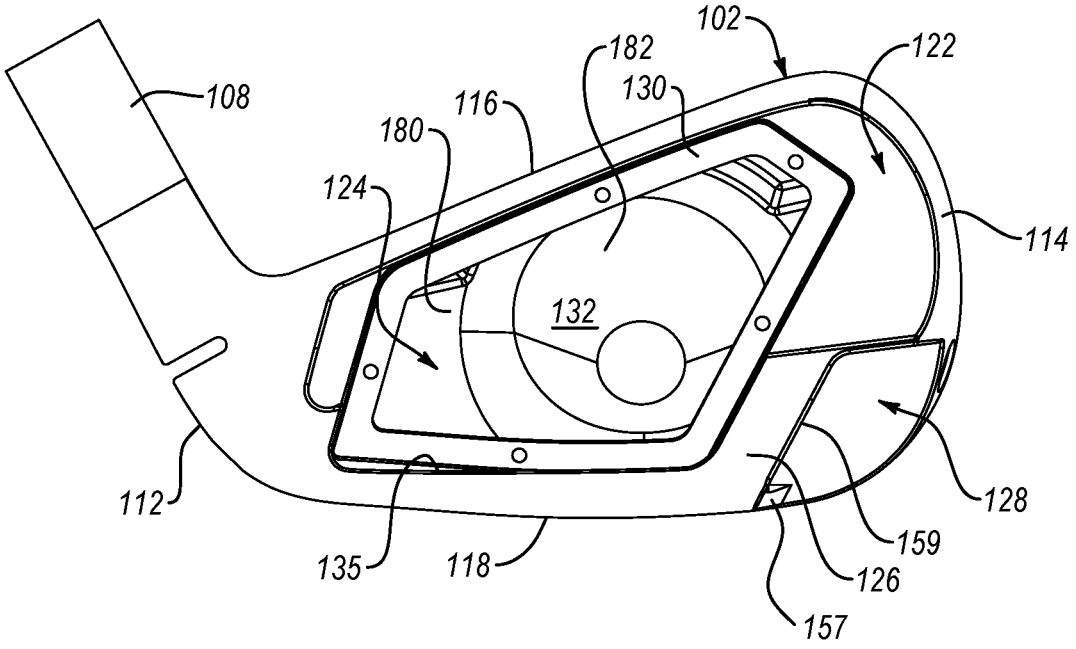
FIG. 5 is a rear view of the golf club head of FIG. 1, shown with a rear panel and a high-density insert removed, according to one or more examples of the present disclosure.
Figure 6:
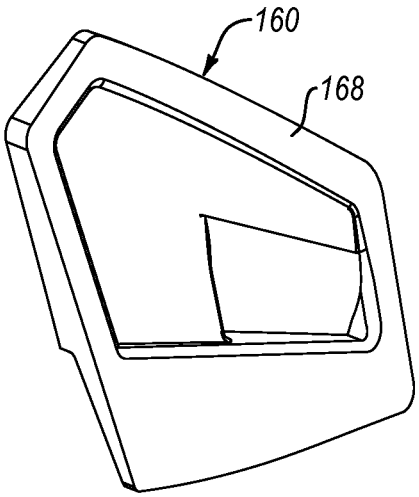
FIG. 6 is a perspective view of a rear panel of the golf club head of FIG. 1, from a front of the rear panel, according to one or more examples of the present disclosure.
Figure 7:
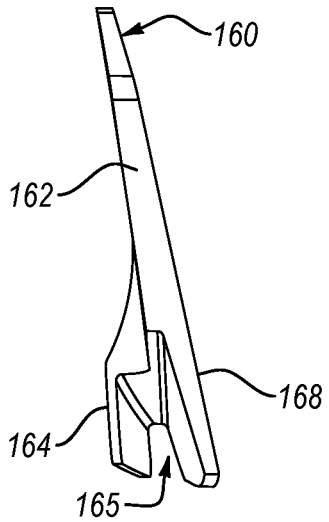
FIG. 7 is a side view of the rear panel of FIG. 6, according to one or more examples of the present disclosure.
Figure 8:
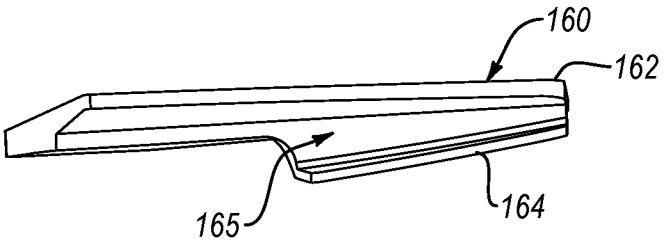
FIG. 8 is a bottom view of the rear panel of FIG. 6, according to one or more examples of the present disclosure.
Figure 9:
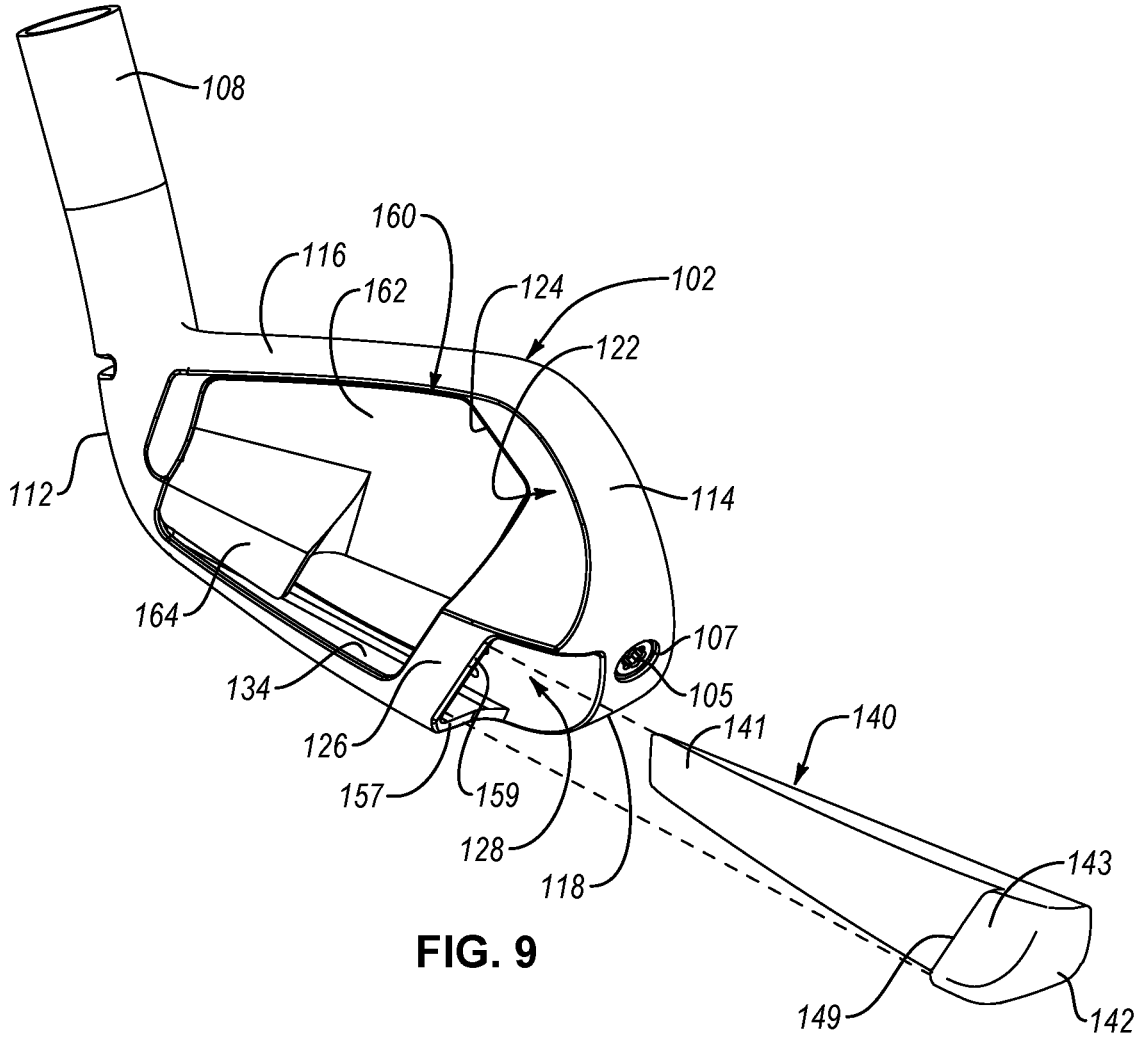
FIG. 9 is an exploded perspective view of the golf club head of FIG. 1, according to one or more examples of the present disclosure.

FIGS. 4 and 5 are examples that show a golf club head in the address position (i.e. the club head is positioned such that a hosel axis, of the club head, is at a 60 degree lie angle relative to a ground plane and the club face is square relative to an imaginary target line). As shown in FIGS. 4 and 5, positioning a golf club head 100 in the reference position lends itself to using a club head origin coordinate system for making various measurements. Additionally, the USGA methodology may be used to measure the various parameters described throughout this application including head height, club head center of gravity (CG) location, and moments of inertia (MOI) about the various axes.

For further details or clarity, the reader is advised to refer to the measurement methods described in the '946 App and the USGA procedure. Notably, however, the origin and axes used in this application may not necessarily be aligned or oriented in the same manner as those described in the '946 App or the USGA procedure. Further details are provided below on locating the club head origin coordinate system.

Figure 1:
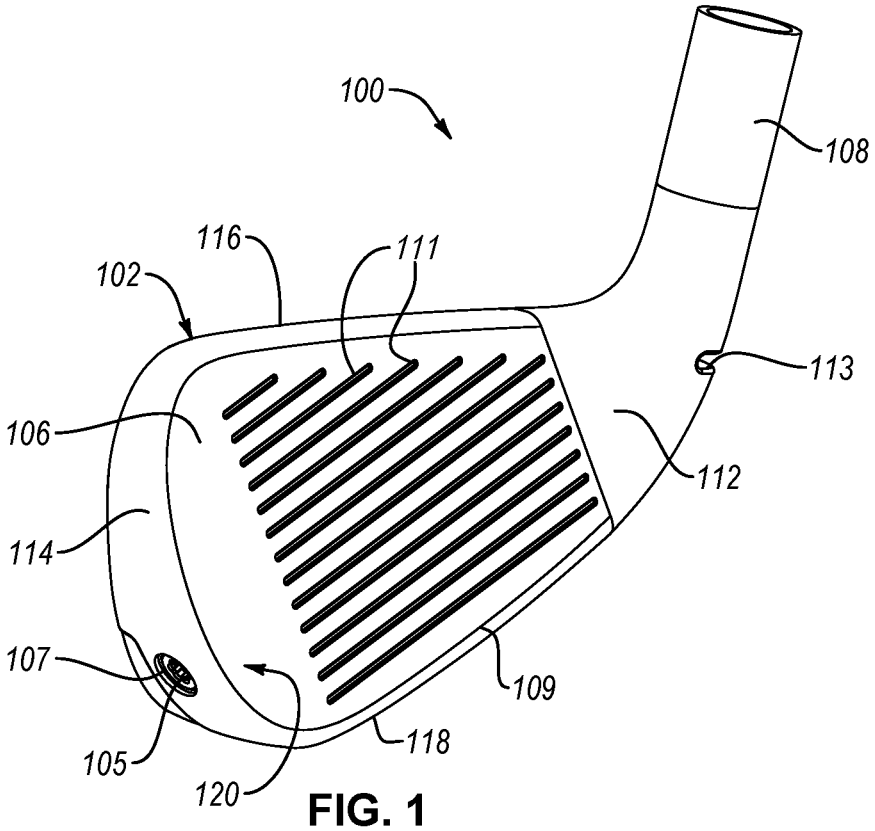
FIG. 1 is a perspective view of an iron-type golf club head, from a front of the golf club head, according to one or more examples of the present disclosure.
Figure 2:
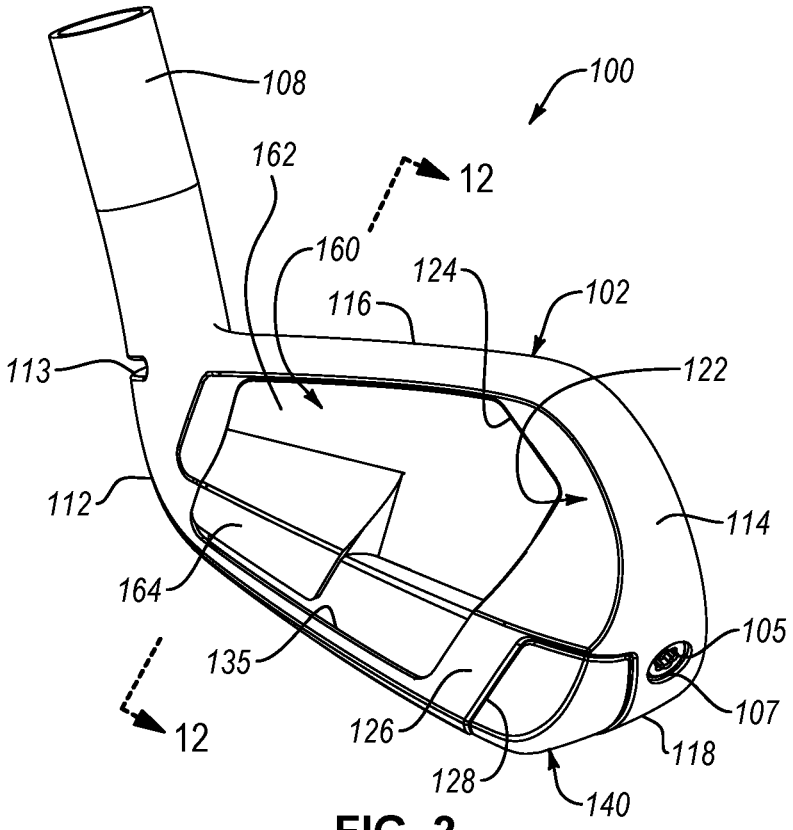
FIG. 2 is perspective view of the golf club head of FIG. 1, from a rear of the golf club head, according to one or more examples of the present disclosure.

Referring to FIGS. 1 and 2, one example of a golf club head 100 includes a body 102, a rear panel 160 coupled to the body 102, and a high-density insert 140 coupled to the body 102 and the rear panel 160. The golf club head 100 additionally includes a hosel 108 coupled to and extending from the body 102. Some features of the golf club head 100 are similar to the features of the iron-type golf club head shown and described in U.S. patent application Ser. No. 15/706,632, filed Sep. 15, 2017, which is incorporated herein in its entirety.

The body 102 has a toe portion 114, a heel portion 112, a top portion 116 (e.g., top-line portion), and a sole portion 118 (e.g., bottom portion). The hosel 108 extends from the heel portion 112 of the body 102. The hosel 108 is configured to receive and engage with a shaft and grip of a golf club. The shaft extends from the hosel 108 and the grip is secured to the shaft at a location on the shaft opposite that of the golf club head 100. In certain examples, the hosel 108 includes a hosel slot 113 proximate the heel portion 112 of the body 102 of the golf club head 100.

The body 102 also includes a front portion 120 and a rear portion 122. The front portion 120 includes a strike face 106 designed to impact a golf ball during a normal golf swing. The strike face 106 has a face length LF that is equal to the distance between a par line 195 of the golf club head 100 and a toewardmost point of the golf club head 100 as shown in FIG. 4. The par line 195 is defined as the theoretical line defining the transition on the front portion 120 between a flat surface to a curved surface generally proximate to the heel end of the golf club head. Put another way, the par line 195 defines where the flat surface of the front portion 120 ends and the curved surface of the front portion 120 begins. Opposite the strike face 106, the front portion 120 includes an interior surface 180. In some examples, the interior surface 180 includes a variable thickness projection 182, that projects rearwardly. The strike face 106, in the examples of FIGS. 1-12, is co-formed with the body 102, such that the body 102 and the strike face 106 form a one-piece, monolithic, seamless, and unitary, construction. Accordingly, the body 102 and the strike face 106 are formed from the same manufacturing process, such as being co-cast or co-machined together in certain examples. In some examples, a thickness of the front portion 120 defining the strike face 106, proximate a center of the strike face 106, is between 2.2 mm and 3.8 mm. In other examples, the thickness of the front portion 120 defining the strike face 106, proximate a center of the strike face 106, is between 2.2 mm and 3.6 mm or 3.4 mm. A range of the thickness of the face portion 120 can be between 1.8 mm and 3.5 mm. The strike face 106 includes a leading edge 109, which is defined as the forwardmost portion or edge of the strike face 106. The thickness of the front portion 120 defining the strike face 106 can be variable across the strike face 106.

In some examples, the golf club head 100 is configured with dimensions similar to a blade-style golf club head. For example, an offset, in a front-to-rear direction, between a forwardmost portion of the hosel 108 and the leading edge 109 of the strike face 106 is less than or equal to 4.5 mm in certain implementations (e.g., less than or equal to 3.9 mm, 3.4 mm, 2.9 mm, or 2.3 mm). According to another example, a blade length LB of the body 102 is less than or equal to 82 mm (e.g., less than or equal to 81 mm, 80 mm, or 79 mm). In yet another example, an overall width of the sole portion 118 is less than or equal to 25.5 mm (e.g., less than or equal to 24 mm or 23 mm). Also, in some examples, a maximum width of the top portion 116 (e.g., topline portion) is less than or equal to 6.3 mm (e.g., less than or equal to 6.1 mm).

As used herein, the blade length LB of the golf club head 100 is the distance between a ground plane intersection point (GPIP) and the toewardmost point of the golf club head 100, when the golf club head 100 is in proper address position on the ground plane 191, which includes the grooves 107 being parallel to the ground plate 191 (see, e.g., FIG. 4). The GPIP is defined as the intersection of the ground plane 191 and a central axis 193 of the hosel 108 when the golf club head 100 is in proper address position on the ground plane 191.

Generally, for many iron-type golf club heads, such as the golf club head 100, the strike face 106 has a planar surface that is angled relative to a ground plane when the golf club head 100 is in an address position to define a loft of the golf club head 100. In other words, the strike face 106 of an iron-type golf club head generally does not include a curved surface. Accordingly, the strike face 106 of the iron-type golf club head 100 is defined as the portion of the strike face 106 with an outwardly facing planar surface. The front portion 120 further includes grooves 107 formed in the strike face 106 to promote desirable flight characteristics (e.g., backspin) of the golf ball upon being impacted by the strike face 106.

In some examples, the body 102, including the heel portion 112, the toe portion 114, the sole portion 118, the top portion 116, the front portion 120, and at least a portion of the rear portion 122, is made of a titanium alloy. As will be explained below, in these examples, the rear panel 160 is not made of a titanium alloy, or more generally, is made of a material that is different than the material of the rest of the body 102. The titanium alloy of the body 102 can be any of various titanium alloys. According to certain examples, the titanium alloy of the body 102 includes one or more of 9-1-1, 3-2.5, 6-4, SP700, 15-3-3-3, 10-2-3, or other alpha/near alpha, alpha-beta, and beta/near beta titanium alloys.

In one example, the titanium alloy of the body 102 is a 9-1-1 titanium alloy. Titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys. Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation. In certain examples, the titanium alloy is 8-1-1 Ti.

In another example, the titanium alloy of the body 102 is an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" or "ZA1300" titanium alloy). In another representative example, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti. In yet another representative example, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti. In a further representative example, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti. In another representative example, the alloy may comprise 8% Al by weight, 2.5% Mo by weight, 2% Cr by weight, 1% V by weight, and/or 0.5% Fe by weight, with the balance comprising Ti (such titanium alloys can have the formula Ti-8Al-2.5Mo-2Cr-1V-0.5Fe). As used herein, reference to "Ti-8Al-2.5Mo-2Cr-1V-0.5Fe" refers to a titanium alloy including the referenced elements in any of the proportions given above. Certain examples may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some examples, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular examples, the Ti-8Al-2.5Mo-2Cr-1V-0.5Fe alloy can have a tensile strength of about 1320 MPa, a yield strength of about 1284 MPa, and an elongation of about 10%. The Ti-8Al-2.5Mo-2Cr-1V-0.5Fe alloy, particularly when used to cast golf club head bodies, promotes less deflection for the same thickness due to a higher ultimate tensile strength compared to other materials. In some implementations, providing less deflection with the same thickness benefits golfers with higher swing speeds because over time the face of the golf club head will maintain its original shape over time.

Figure 3:
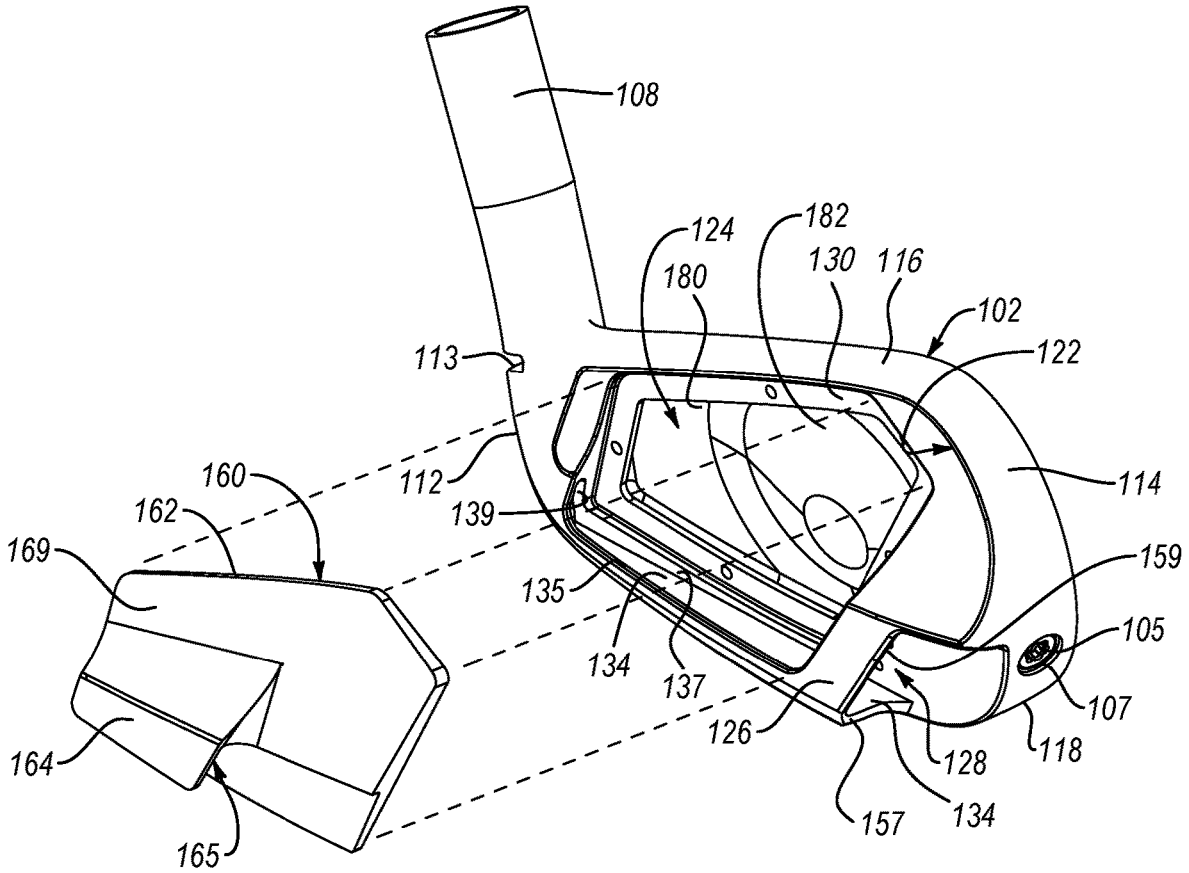
FIG. 3 is an exploded perspective view of the golf club head of FIG. 1, from a rear of the golf club head and shown with a high-density insert removed, according to one or more examples of the present disclosure.

Referring to FIGS. 2 and 3, the rear portion 122 of the body 102 includes an insert shelf 134 and a retention bar 126. The insert shelf 134 is adjacent the sole portion 118. In other words, an interior surface of the sole portion 118 at least partially defines the insert shelf 134. The insert shelf 134 extends from the toe portion 114 to the heel portion 112. Accordingly, the insert shelf 134 is elongated in a toe-to-heel direction. Moreover, in certain examples, the insert shelf 134 is substantially parallel to the strike face 106. The insert shelf 134 includes a flat surface that is configured to vertically support the high-density insert 140. In other words, the insert shelf 134 constrains movement of the high-density insert 140 in a vertically downward direction. The surface area of the insert shelf 134 decreases in a toe-to-heel direction. In other words, the insert shelf 134 tapers or converges in the toe-to-heel direction to accommodate a taper or convergence in the high-density insert 140. In some examples, the high-density insert 140 has a variable mass per unit length that varies in a heel-to-toe direction, a toe portion of the high-density insert 140 is located at least 20 mm toeward of a geometric center of the strike face 106, and a central portion (between the toe portion and a heel portion of the insert) is located within 20 mm of the geometric center of the strike face 106. Additionally, in certain examples, the high-density insert 140 has a variable density along a length of the insert, such that, for example, the toe portion of the high-density insert 140 has a greater density than the heel portion or central portion of the high-density insert 140.

According to some examples, the rear portion 122 also includes a front ridge 137 and a rear ridge 135, co-formed with the front portion 120, that extends along a front portion of the insert shelf 134 and a rear portion of the insert shelf 134, respectively, to at least partially constrain forward movement and rearward movement, respectively, of the high-density insert 140 relative to the body 102. Accordingly, the insert shelf 134 is interposed between the front ridge 137 and the rear ridge 135. The rear ridge 135 is rearwardly offset from the rear panel 160.

In some examples, the rear portion 122 of the body 102 includes an end pocket 139 that is configured to matingly receive a heelward end 141 of the high-density insert 140. The end pocket 139 is formed in the heel portion 112 of the body 102. A portion of the insert shelf 134 extends into and defines a surface of the end pocket 139. The end pocket 139 is circumferentially closed. Accordingly, the end pocket 139 circumferentially closes, or entirely circumferentially surrounds, the heelward end 141 of the high-density insert 140 when the heelward end 141 is matingly inserted into the end pocket 139. The end pocket 139 helps to constrain movement of the heelward end 141 in upward-downward directions and forward-backward directions relative to the strike face 106.

The rear portion 122 of the body 102 additionally includes the retention bar 126, which defines an exterior surface of the iron-type golf club head 100. The retention bar 126 circumferentially closes a portion of the insert shelf 134. The portion of the insert shelf 134 circumferentially closed by the retention bar 126 is a toeward portion of the insert shelf 134 or a portion of the insert shelf 134 at least partially defined by the toe portion 114 of the body 102. The retention bar 126 helps define a rear surface of a first insert channel 128 formed in the rear portion 122 of the body 102. The first insert channel 128 is also defined by the insert shelf 134, an interior rear surface of the rear portion 122, and an interior top surface of the rear portion 122. More specifically, the insert shelf 134 defines a bottom surface of the first insert channel 128, the interior rear surface of the rear portion 122 defines a forward surface of the first insert channel 128, and the interior top surface of the rear portion 122 defines a top surface of the first insert channel 128. As shown, in some examples, the retention bar 126 is integrally formed with a portion of the insert shelf 134, such that the retention bar 126 forms a one-piece, seamless, and unitary monolithic structure with the insert shelf 134. The first insert channel 128 is a circumferentially closed channel. In other words, the first insert channel 128 has open ends and is enclosed on all sides of the first insert channel 128 extending between the open ends. In this manner, the first insert channel 128 helps constrain movement of a toeward end 143, opposite the heelward end 141, of the high-density insert 140 in the upward-downward directions and the forward-backward directions relative to the strike face 106.

The retention bar 126 has a width, in a toe-to-heel direction, that is less than a length of the insert shelf 134, in the toe-to-heel direction. Accordingly, the width of the retention bar 126 is less than a length of the high-density insert 140. In one example, the width of the retention bar 126 is less than 50% of the length of the high-density insert 140. In another example, the width of the retention bar 126 is less than 25% of the length of the high-density insert 140. In yet another example, the width of the retention bar 126 is less than 10% of the length of the high-density insert 140.

The rear portion 122 of the golf club head 100 additionally includes a rear opening 124 and a rear panel 160 coupled to and enclosing the rear opening 124. The rear opening 124 is open to an internal cavity 132 of the body 102 of the golf club head 100. In other words, the internal cavity 132 is accessible through the rear opening 124 when uncovered. The rear portion 122 includes a lip 130 continuously surrounding the rear opening 124. The lip 130 is recessed relative to adjacent surfaces of the rear portion 122 and configured to receive the rear panel 160 in seated engagement. Additionally, the lip 130 is offset forwardly of the insert shelf 134. The size and shape of the outer periphery of the rear panel 160 complements the size and shape of the lip 130, such that when in seated engagement with the lip 130, the rear panel 160 covers the entirety of the rear opening 124. In this manner, the rear panel 160 encloses the rear opening 124, as well as the internal cavity 132. Accordingly, when the rear panel 160 is in seated engagement with the lip 130, the body 102 of the golf club head 100 is hollow (i.e., the internal cavity 132 is enclosed). For this reason, the iron-type golf club head 100 is considered to have a hollow-body design.

Referring to FIGS. 3-8, the rear panel 160 includes a base 162 having an outer periphery with a size and shape corresponding with the size and shape of the lip 130. An interior surface 168 of the base 162, about a periphery of the base 162, is flat and configured to seat against the flat surface of the lip 130. The rear panel 160 is coupled to the lip 130 in any of various ways. In some examples, depending on the material of which the rear panel 160 is made, the rear panel 160 is adhered to, welded to, or bonded to the lip 130.

The rear panel 168 includes a retention flap 164 that extends from and is integrally formed with an exterior surface 169 of the base 162, such that the retention flap 164 defines an exterior surface of the iron-type golf club head 100. The retention flap 164 first extends rearwardly away from the exterior surface 169 of the base 162 and then downwardly and offset from the exterior surface 169. Accordingly, a gap 165 is defined between the downwardly extending portion of the retention flap 164 and the exterior surface 169. In some examples, a cross-sectional area of the gap 165 decreases in a heel-to-toe direction such that the gap 165 tapers or diverges in the heel-to-toe direction to accommodate the shape of the high-density insert 140.

The retention flap 164 is spaced apart from the retention bar 126 in the toe-to-heel direction. Accordingly, a space is defined between the retention flap 164 and the retention bar 126 in the toe-to-heel direction. Moreover, the retention flap 164 has a length, in a toe-to-heel direction, that is less than a length of the insert shelf 134, in the toe-to-heel direction. Accordingly, the length of the retention flap 164 is less than a length of the high-density insert 140. In some examples, the length of the retention flap 164 is more than the width of the retention bar 126. According to one example, the length of the retention flap 164 is less than 50% of the length of the high-density insert 140. In another example, the length of the retention flap 164 is less than 25% of the length of the high-density insert 140.

Figure 12:
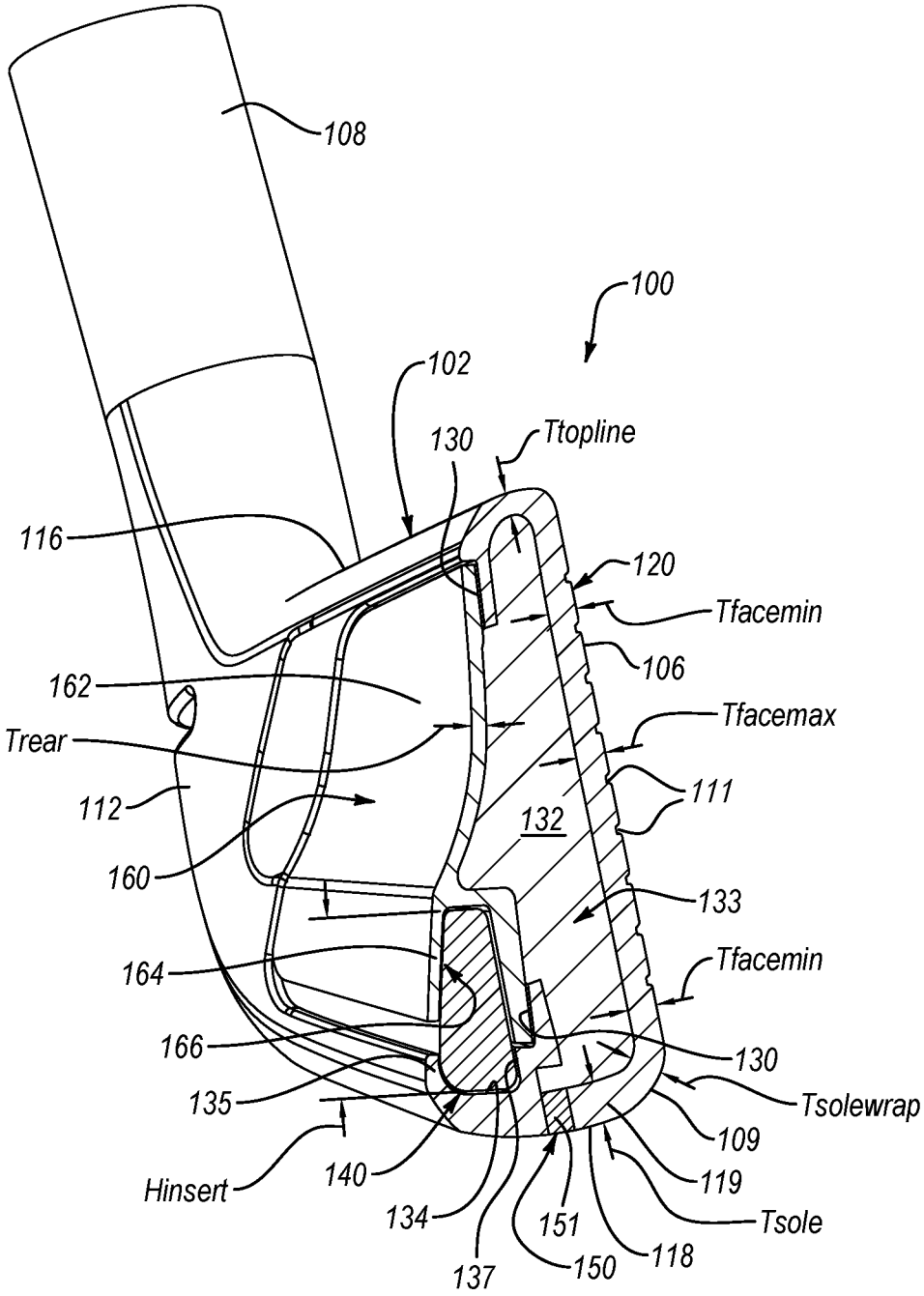
FIG. 12 is a cross-sectional perspective view of the golf club head of FIG. 1, taken along the line 12-12 of FIG. 2, according to one or more examples of the present disclosure.
Figure 13:
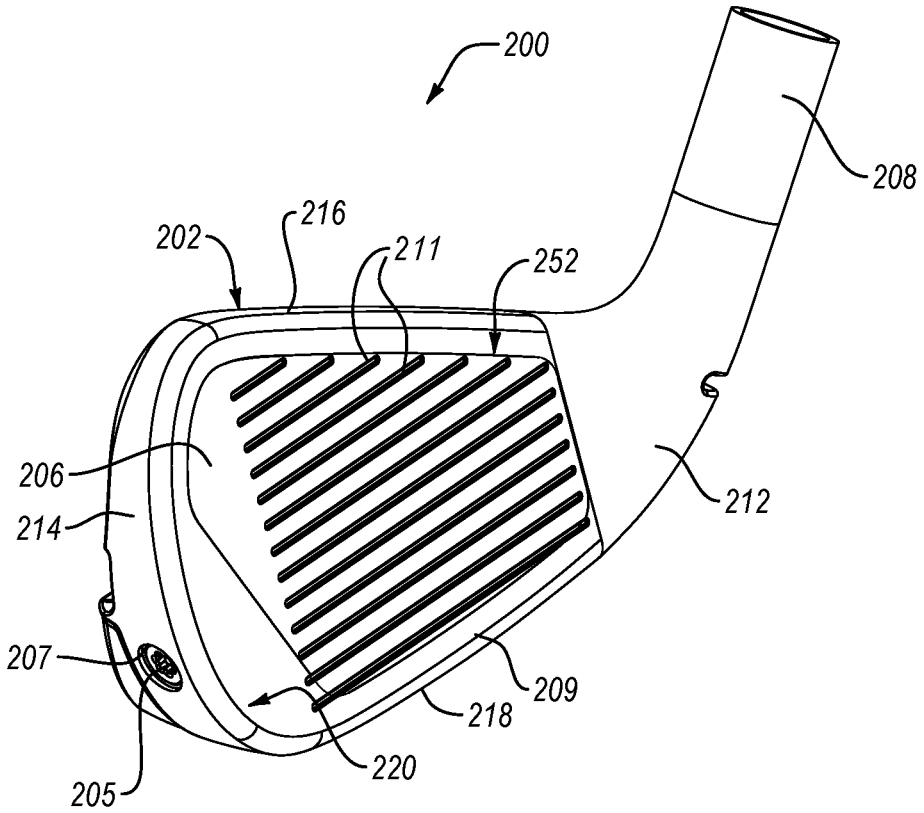
FIG. 13 is a perspective view of an iron-type golf club head, from a front of the golf club head, according to one or more examples of the present disclosure.

The retention flap 164 is spaced apart from the insert shelf 134 and at least partially circumferentially closes a portion of the insert shelf 134 to define a second insert channel 166 (see, e.g., FIG. 12). In other words, the second insert channel 166 is defined by the gap 165 and the insert shelf 134. Put another way, the second insert channel 166 is defined between the exterior surface 165 of the base 162, the retention flap 164, and the insert shelf 134. The taper or convergence of the gap 165 complements the taper or convergence of the insert shelf 134. Accordingly, the second insert channel 166 tapers or converges in the toe-to-heel direction to accommodate the taper or convergence of the high-density insert 140.

In one example, the retention flap 164 only partially circumferentially closes the portion of the insert shelf 134. As shown in FIG. 4, the downwardmost edge of the retention flap 164 is vertically spaced apart from the rear ridge 135 of the rear portion 122 such that a gap or opening exists between the retention flap 164 and the rear ridge 135. Access to the second insert channel 166 is available through this gap and thus the second insert channel 166 is not circumferentially closed. However, in another example, the retention flap 164 may extend into abutting engagement with the rear ridge 135 such that the insert shelf 134 is circumferentially closed at the retention flap 164.

The rear panel 160 is made of a second material different than a first material of the heel portion 112, the toe portion 114, the sole portion 118, the top portion 116, the front portion 120, and the insert shelf 134 and the retention bar 126 of the rear portion 122 in some examples. The first material has a density that is lower than the density of the high-density insert 140 and higher than the density of the second material of the rear panel 160. In one example, the density of the second material of the rear panel 160 is greater than 1 g/cc. For example, the second material is one or more of a titanium alloy, a steel alloy, an aluminum alloy, or a polymer. According to other examples, the second material of the rear panel 160 is the same as the first material of the heel portion 112, the toe portion 114, the sole portion 118, the top portion 116, the front portion 120, and the insert shelf 134 and the retention bar 126 of the rear portion 122.

The high-density insert 140 is supported by the insert shelf 134 and non-movably retained within the first insert channel 128 by the retention bar 126. Additionally, the high-density insert 140 is non-movably retained within the second insert channel 166 by the retention flap 164. Some additional retention of the high-density insert 140 is provided by the rear ridge 135 lining a portion of the insert shelf 134. The high-density insert 140 is in seated engagement with the insert shelf 134 while in mating engagement with the first insert channel 128, the second insert channel 166, and the end pocket 139. Additionally, the high-density insert 140 is engaged with the exterior surface 169 of the base 162 of the rear panel 160 to constrain forward movement of the high-density insert 140 relative to the strike face 106.

Engagement with the insert shelf 134, the first insert channel 128, the second insert channel 166, and the end pocket 139 is provided by inserting the high-density insert 140, from the toe portion 114 in a substantially toe-to-heel direction, through first insert channel 128, along the insert shelf, through the second insert channel 166, and into the end pocket 139. In some examples, the high-density insert 140 is retained in placed during use by adhering (e.g. gluing, such as with glue or epoxy) the high-density insert 140 to at least one of the surfaces of the body 102 to which the high-density insert 140 is engaged. In other words, the high-density insert 140 is adhesively held in place. Accordingly, in some examples, the high-density insert 140 is attached to the body 102 by a method other than welding, brazing, soldering, or with mechanical fasteners (i.e., the high-density insert 140 is not welded, brazed, soldered, or fastened to the body 102), which avoids the complexity, weaknesses, and weight gains associated with these types of attachment techniques. Other than an adhesive material, there is no intervening layers (e.g., damping material) between the high-density insert 140 and the body 102 of the golf club head 100.

Figure 10:
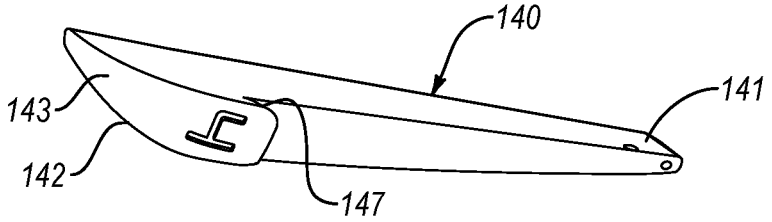
FIG. 10 is a perspective view of a high-density insert of the golf club head of FIG. 1, from a bottom of the high-density insert, according to one or more examples of the present disclosure.
Figure 11:
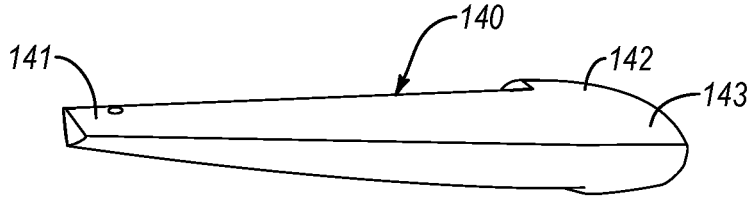
FIG. 11 is a perspective view of a high-density insert of the golf club head of FIG. 1, from a top of the high-density insert, according to one or more examples of the present disclosure.

Referring to FIGS. 10 and 11, the high-density insert 140 is an elongated and asymmetrical insert. According to certain examples, the high-density insert 140 has an overall length of at least 65 mm, at least 70 mm, or at least 75 mm. In some examples, the overall length of the high-density insert 140 is between 90% and 110% of a blade length LB of the body 102. According to yet certain examples, the overall length of the high-density insert 140 is greater or longer than the face length LF of the strike face 106 of the golf club head 100. In some examples, both the mass distribution and the shape of the high-density insert 140 are asymmetrical. The high-density insert 140 includes the heelward end 141 and the toeward end 143. The heelward end 141 is opposite the toeward end 143. The heelward end 141 is located in the heel portion 112 of the body 102 and the toeward end 143 is located in the toe portion 114 of the body 102. The toeward end 143 of the high-density insert 140 is more massive, or has more mass, than the heelward end 141. Such a configuration distributes more mass to the toe portion 114 than the heel portion 112. Additionally, the toeward end 143 of the high-density insert 140 is larger than the heelward end 141. Accordingly, in some examples, the density of the material of the high-density insert 140 at the toeward end 143 and the heelward end 141 is uniform. In other examples, the density of the material of the high-density insert 140 can be different (e.g., lower) in the heelward end 141 compared to the toeward end 143. The high-density insert 140 has a one-piece, unitary and seamless, monolithic construction in some examples.

According to certain examples, the high-density insert 140 tapers or converges from the toeward end 143 to the heelward end 141. The taper can be constant from the toeward end 143 to the heelward end 141. In some examples, the high-density insert 140 also tapers or converges from a bottom of the insert to a top of the insert. For example, the high-density insert 140 can have a triangular cross-sectional shape along a plane perpendicular to the length of the insert.

In the illustrated examples, the high-density insert 140 includes a head 142 at the toeward end 143. The head 142 is defined by a sole ledge 147 and a rear ledge 149. When coupled to the body 102, the sole ledge 147 engages a toeward edge 157 of the sole portion 118 and the rear ledge 149 engages a toeward edge 159 of the retention bar 126. Engagement between the sole ledge 147 and the toeward edge 157 and between the rear ledge 149 and the toeward edge 159 helps to stop the high-density insert 140 in a proper position relative to the body 102. The head 142 of the high-density insert 140 defines a portion of the exterior surface of the golf club head 100 at the toe portion 114 and rear portion 122 of the body 102. Additionally, a portion of the high-density insert 140 between the heelward end 141 and the toeward end 143 defines the exterior surface of the golf club head 100 at the rear portion 122 of the body 102 between the retention bar 126 and the retention flap 164. Accordingly, in contrast to conventional golf club heads with high-density plugs entirely hidden internally within in the golf club head, the high-density insert 140 is exposed to the exterior of the golf club head 100 to define a portion of the exterior surface of the golf club head 100. Similarly, the high-density insert 140 is external to the internal cavity 132 such that no portion of the high-density insert 140 is located within or defines any part of the internal cavity 132. The high-density insert 140 defines a relatively large portion of the exterior surface of the golf club head 100. In one example, a surface area of a total exterior surface of the iron-type golf club head 100 defined by the high-density insert 140 is at least 150 mm^2. In certain examples, a surface area of the toe portion of the iron-type golf club head defined by the high-density insert is at least 50 mm^2.

The high-density insert 140 is made of a high-density material. As defined herein a high-density material is a material having a density of at least 7.5 grams-per-cubic-centimeter (g/cc) and a density greater than the density of the body 102. In some examples, the density of the high-density material is at least 16.7 g/cc. Various metal materials have qualifying densities. In some examples, the high-density material of the high-density insert 140 is a tungsten alloy. According to these examples, the heel portion 112, the toe portion 114, the sole portion 118, the top portion 116, the front portion 120, and the insert shelf 134 and the retention bar 126 of the rear portion 122 is made of a titanium alloy, and the rear panel 160 is made of a steel alloy, an aluminum alloy, or a polymer. The tungsten alloy of the high-density insert 140 can be any one of various tungsten alloys. In one example, the high-density insert 140 has a mass of at least 50 grams, at least 80 grams, at least 90 grams, or at least 100 grams (e.g., up to 125 grams). The total mass of the high-density insert 140 can be at least 30% of the total mass of the golf club head 100, such as, for example, between 35% and 50% or preferably between 39% and 46% of the total mass of the golf club head 100.

In certain examples of the golf club head 100, as shown in FIG. 12, the internal cavity 132 is partially or entirely filled with a filler material 133. In some implementations, the filler material 133 is made from a non-metal, such as a thermoplastic material, thermoset material, and the like. In other implementations, the internal cavity 132 is not filled with a filler material 133, but rather maintains an open, vacant, cavity within the club head.

According to some examples, the filler material 133 is initially a viscous material that is injected or otherwise inserted into the club head through an injection port 107 (see, e.g., FIG. 9) located on the toe portion 114 of the golf club head 100. However, in other examples, the injection port 107 can be located anywhere on the golf club head 100, including the top portion 116, the sole portion 118, the heel portion 112, or the toe portion 114. The injection port 107 can be sealed with a plug 105 after the filler material 133 is injected into the internal cavity 132. In one example, the plug 105 is a metallic plug that can be made from steel, aluminum, titanium, or a metallic alloy. According to an example, the plug 105 is an anodized aluminum plug that is colored a red, green, blue, gray, white, orange, purple, black, clear, yellow, or metallic color. In one example, the plug 105 is a different or contrasting color from the majority color located on the body 102 of the golf club head 100. In still other examples, the filler material 133 may be pre-formed and placed into the golf club head 100 and sealed in place with a plug, cover, resilient cap, or other structure formed of a metal, metal alloy, metallic, composite, hard plastic, resilient elastomeric, or other suitable material.

Examples of materials that may be suitable for use as the filler material 133 to be injected or placed into the internal cavity 132 of the golf club head 100 include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFIex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. In some examples, the filler material 133 is a two part polyurethane foam that is a thermoset and is flexible after it is cured. In one example, the two part polyurethane foam is any methylene diphenyl diisocyanate (a class of polyurethane prepolymer) or silicone based flexible or rigid polyurethane foam.

In one example, the filler material 133 has a minor impact on the coefficient of restitution (herein "COR") as measured according to the United States Golf Association (USGA) rules set forth in the Procedure for Measuring the Velocity Ratio of a Club Head for Conformance to Rule 4-1e, Appendix II Revision 2 Feb. 8, 1999, herein incorporated by reference in its entirety.

Table 1 below provides examples of the COR change relative to a calibration plate of multiple club heads of the construction shown in FIG. 12 in both a filled and unfilled state. The calibration plate dimensions and weight are described in section 4.0 of the Procedure for Measuring the Velocity Ratio of a Club Head for Conformance to Rule 4-1e.

Due to the slight variability between different calibration plates, the values described below are described in terms of a change in COR relative to a calibration plate base value. For example, if a calibration plate has a 0.831 COR value, Example 1 for an un-filled head has a COR value of −0.019 less than 0.831 which would give Example 1 (Unfilled) a COR value of 0.812. The change in COR for a given head relative to a calibration plate is accurate and highly repeatable.

TABLE 1

| COR Values Relative to a Calibration Plate | | | |
|---|---|---|---|
| Example No. | Unfilled COR Relative to Calibration Plate | Filled COR Relative to Calibration Plate | COR Change Between Filled and Unfilled |
| 1 | −0.019 | −0.022 | −0.003 |
| 2 | −0.003 | −0.005 | −0.002 |

TABLE 1-continued

| COR Values Relative to a Calibration Plate | | | |
|---|---|---|---|
| Example No. | Unfilled COR Relative to Calibration Plate | Filled COR Relative to Calibration Plate | COR Change Between Filled and Unfilled |
| 3 | −0.006 | −0.010 | −0.004 |
| 4 | −0.006 | −0.017 | −0.011 |
| 5 | −0.026 | −0.028 | −0.002 |
| 6 | −0.007 | −0.017 | −0.01 |
| 7 | −0.013 | −0.019 | −0.006 |
| 8 | −0.007 | −0.007 | 0 |
| 9 | −0.012 | −0.014 | −0.002 |
| 10 | −0.020 | −0.022 | −0.002 |
| Average | −0.0119 | −0.022 | −0.002 |

Table 1 illustrates that before the filler material 133 is introduced into the cavity 132 of golf club head 100, an Unfilled COR drop off relative to the calibration plate (or first COR drop off value) is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005.

In one example, the average COR drop off or loss relative to the calibration plate for a plurality of Unfilled COR golf club head within a set of irons is between 0 and −0.05, between 0 and −0.03, between −0.00001 and −0.03, between −0.00001 and −0.025, between −0.00001 and −0.02, between −0.00001 and −0.015, or between −0.00001 and −0.01.

Table 1 further illustrates that after the filler material 133 is introduced into the cavity 132 of golf club head 100, a Filled COR drop off relative to the calibration plate (or second COR drop off value) is more than the Unfilled COR drop off relative to the calibration plate. In other words, the addition of the filler material 133 in the Filled COR golf club heads slows the ball speed (Vout—Velocity Out) after rebounding from the face by a small amount relative to the rebounding ball velocity of the Unfilled COR heads.

In some examples shown in Table 1, the COR drop off or loss relative to the calibration plate for a Filled COR golf club head is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005. According to one example, a COR change value (e.g., the difference between a measured COR value of the iron-type golf club head 100 and a United States Golf Association (USGA)-governed calibration plate COR value) of the golf club head 100 is at least −0.025.

In one example, the average COR drop off or loss relative to the calibration plate for a plurality of Filled COR golf club head within a set of irons is between 0 and −0.05, between 0 and −0.03, between −0.00001 and −0.03, between −0.00001 and −0.025, between −0.00001 and −0.02, between −0.00001 and −0.015, between −0.00001 and −0.01, or between −0.00001 and −0.005.

However, the amount of COR loss or drop off for a Filled COR head is minimized when compared to other constructions and filler materials. The last column of Table 1 illustrates a COR change between the Unfilled and Filled golf club heads which are calculated by subtracting the Unfilled COR from the Filled COR table columns. The change in COR (COR change value) between the Filled and Unfilled club heads is between 0 and −0.1, between 0 and −0.05, between 0 and −0.04, between 0 and −0.03, between 0 and −0.025, between 0 and −0.02, between 0 and −0.015, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002. Remarkably, one club head was able to achieve a change in COR of zero between a filled and unfilled golf club head. In other words, no change in COR between the Filled and Unfilled club head state. In some examples, the COR change value is greater than −0.1, greater than −0.05, greater than −0.04, greater than −0.03, greater than −0.02, greater than −0.01, greater than −0.009, greater than −0.008, greater than −0.007, greater than −0.006, greater than −0.005, greater than −0.004, or greater than −0.003.

In some examples, at least one, two, three or four iron golf clubs out of an iron golf club set has a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

In yet other examples, at least one pair or two pair of iron golf clubs in the set have a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

In other examples, an average of a plurality of iron golf clubs in the set has a change in COR between the Filled and Unfilled states of between 0 and −0.1, between 0 and −0.05, between 0 and −0.04, between 0 and −0.03, between 0 and −0.02, between 0 and −0.01, between 0 and −0.009, between 0 and −0.008, between 0 and −0.007, between 0 and −0.006, between 0 and −0.005, between 0 and −0.004, between 0 and −0.003, or between 0 and −0.002.

Referring again to FIG. 12, the front portion 120 of the golf club head 100 includes an undercut feature 119 that wraps underneath the golf club head 100. The undercut feature 119 terminates at a location under the golf club head 100 such that a gap is defined between the undercut feature 119 and the sole portion 118 of the body 102. The gap defines a sole slot 150 of the golf club head 100. Generally, the sole slot 150 is a groove or channel formed in the sole portion 118 of the golf club head 100. The sole slot 150 is elongate in a lengthwise direction substantially parallel to the strike face 106. In some examples, the sole slot 150 is a through-slot, or a slot that is open on a sole portion side of the sole slot 150 and open on an internal cavity side or interior side of the sole slot 150. However, in other implementations, the sole slot 150 is not a through-slot, but rather is closed on an internal cavity side or interior side of the sole slot 150.

In some examples, the sole slot 150 is filled with a filler material 151. The filler material 151 is made from a non-metal, such as a thermoplastic material, thermoset material, and the like, in some implementations. In other implementations, the sole slot 150 is not filled with a filler material 151, but rather maintains an open, vacant, space within the sole slot 150.

According to some examples, the filler material 151 is initially a viscous material that is injected or otherwise inserted into the sole slot 150. Examples of materials that may be suitable for use as a filler to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd.

In some examples, a solid filler material may be press-fit or adhesively bonded into the sole slot 150. In other examples, a filler material may poured, injected, or otherwise inserted into the sole slot 150 and allowed to cure in place, forming a sufficiently hardened or resilient outer surface. In still other examples, a filler material may be placed into the sole slot 150 and sealed in place with a resilient cap or other structure formed of a metal, metal alloy, metallic, composite, hard plastic, resilient elastomeric, or other suitable material.

According to some examples, as shown in FIG. 4, a center of gravity (CG) of the golf club head 100 is no more than between 11 mm and 21 mm from a ground plane when the golf club head 100 is at a proper address position on the ground plane. This value is known as a Zup value. In certain examples, the Zup value of the golf club head 100 is between 15 mm and 17 mm, inclusive.

Now referring to FIGS. 13-21, according to some examples, a golf club head 200 is shown. The golf club head 200 is a hollow-cavity-type golf club head, similar to the golf club head 100 of FIGS. 1-12. Accordingly, unless otherwise noted, like numbers between FIGS. 1-12 and FIGS. 13-21 correspond to like features. For example, like the golf club head 100, the golf club head 200 includes a body 202 with a heel portion 212, a toe portion 214, a sole portion 218, a top portion 216, a front portion 220, and a rear portion 222. The golf club head 200 also includes a hosel 208, an internal cavity 232, a sole slot 250, a filler material 251 in the sole slot 250, a leading edge 209 of the strike face 206, and an undercut feature 219.

One difference between the golf club head 200 and the golf club head 100 is that, instead of a strike face 106 co-formed with the rest of the body 102 (excluding the rear panel 160) to form a one-piece construction, the strike face 206 of the golf club head 200 is formed separately from the rest of the body 102 and attached to the rest of the body 102, such as via a weld. More specifically, the strike face 206 is defined by a strike plate 252 that is welded to the front portion 220 of the body 202. The strike face 206 includes grooves 207.

In some examples, the strike face 106 and the strike face 206 include undulations as shown and described in U.S. patent application Ser. No. 16/160,974, filed Oct. 15, 2018, and U.S. patent application Ser. No. 16/160,884, filed Oct. 15, 2018, which are both incorporated herein by reference in their entirety.

Figure 14:
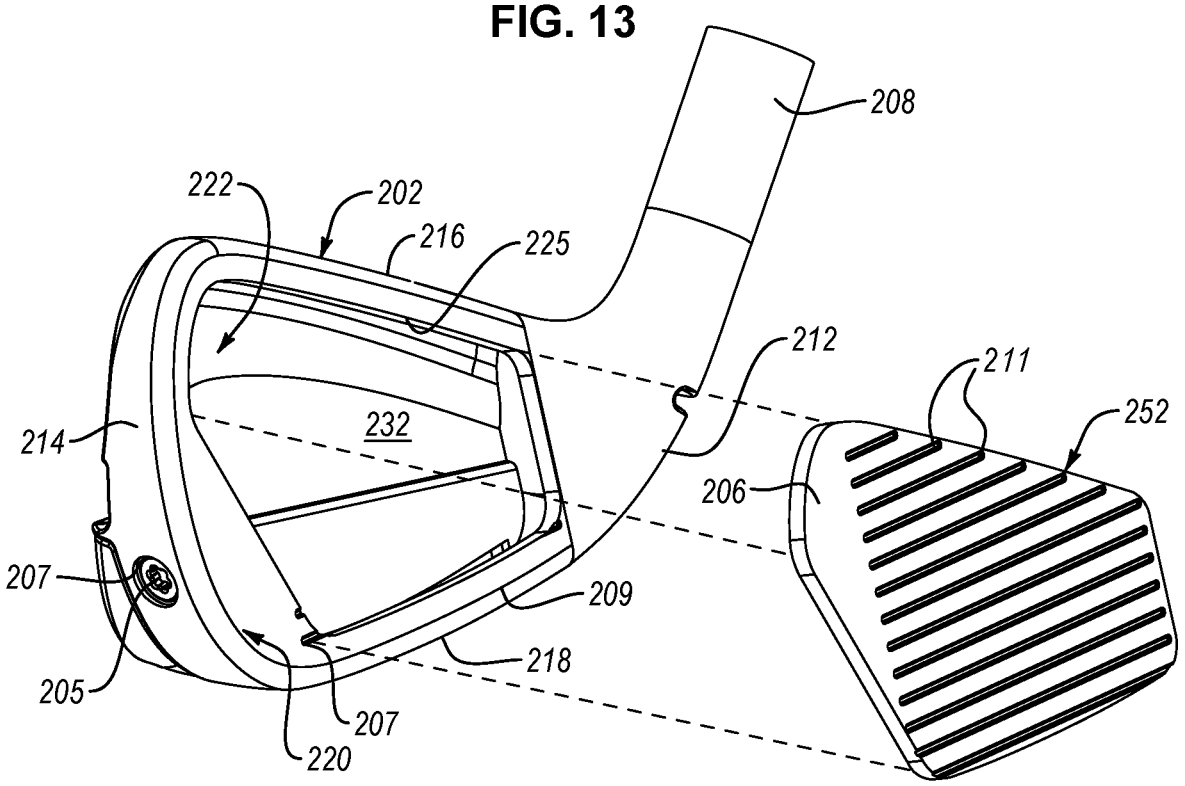
FIG. 14 is an exploded perspective view of the golf club head of FIG. 13, from a front of the golf club head, according to one or more examples of the present disclosure.

Referring to FIG. 14, the strike plate 252 is formed separately from the rest of the front portion 220 of the body 202 and is separately attached to the front portion 220 of the body 202. As used in relation to FIGS. 13-21, unless otherwise noted, for convenience, reference to the body 202 will refer to the portions of the body 202 excluding the strike plate 252. The body 202 and the strike plate 252 can be formed using the same type of process or different types of processes. In the illustrated example, the body 202 is formed to have a one-piece monolithic construction using a first manufacturing process and the strike plate 252 is formed to have a separate one-piece monolithic construction using a second manufacturing process. However, in other examples, one or both of the body 202 and the strike plate 252 has a multiple-piece construction with each piece being made from the same or a different material. Additionally, the body 202 can be formed of the same material as or a different material than the strike plate 252. The body 202 is made from a first material and the strike plate 252 is made from a second material. Separately forming and attaching together the body 202 and the strike plate 252 and making the body 202 and the strike plate 252 from the same or different materials, which allows flexibility in the types of manufacturing processes and materials used, promotes the ability to make a golf club head 200 that achieves a wide range of performance, aesthetic, and economic results.

In some implementations, the first manufacturing process is the same type of process as the second manufacturing process. For example, both the first and second manufacturing processes are casting processes in one implementation. As another example, both the first and second manufacturing processes are forging processes in one implementation. According to yet another example, both the first and second manufacturing processes are machining processes in one implementation.

However, in some other implementations, the first manufacturing process is a different type of process than the second manufacturing process. The first manufacturing process is one of a casting process, a machining process, and a forging process and the second manufacturing process is another of a casting process, a machining process, and a forging process in some examples. In one particular example, the first manufacturing process is a casting process and the second manufacturing process is a forging process. The first manufacturing process and/or the second manufacturing process can be a process as described in U.S. Pat. No. 9,044,653, which is incorporated herein in its entirety, such as hot press forging using a progressive series of dies and heat-treatment.

Whether the first and second manufacturing processes are the same or different, the first material of the body 202 can be the same as or different than the second material of the strike plate 252. A first material is different than a second material when the first material has a different composition than the second material. Accordingly, materials from the same family, such as steel, but with different compositional characteristics, such as different carbon constituencies, are considered different materials. In one example, the first and second manufacturing processes are different, but the first and second materials are the same. In contrast, according to another example, the first and second manufacturing processes are the same and the first and second materials are different. According to yet another example, the first and second manufacturing processes are different and the first and second materials are different. In some implementations, the first and second materials are different, but come from the same family of similar materials, such as titanium.

In some examples, the first material can be the same material as the material of the body 102 and the second material can the same material as that of the body 102. The first material being within the same family as the second material promotes the quality of the weld between the body 202 and the strike plate 252. However, in other examples, the first material can be the same as that of the body 102 and the second material can be different than the material of the body 102. For example, the material of the body 102 can be a titanium alloy, as described above, and the material of the strike plate 104 can be a steel alloy or a fiber-reinforced polymeric composite material.

According to some examples, the strike plate 252 is welded to the body 202 via a peripheral weld. The peripheral weld can be peripherally continuous (extends about all of the outer periphery of the strike plate 252) or peripherally discontinuous (extends about less than all of the outer periphery of the strike plate 252 such that at least one portion of the outer periphery of the strike plate 252 is not welded to the body 202).

The body 202 is configured to receive the portions of an outer peripheral edge of the strike plate 252, to be welded to the body 202 via the peripheral weld, in seated engagement. More specifically, the front portion 220 of the body 202 includes a face opening 225 defined between the toe portion 214, the heel portion 212, the top portion 216, and the sole portion 218 of the body 202. Generally, the face opening 225 receives the strike plate 252 and helps to secure the strike plate 252 to the body 202. The face opening 225 extends entirely through the front portion 220 and is open to the internal cavity 232. Although not shown, the front portion 220 of the body 202 can additionally include a plate interface formed along at least a portion of the periphery of the face opening 225. Generally, the plate interface promotes attachment of the strike plate 252 to the body 202 by supporting the strike plate 252 against the body 202 and promoting the formation of a peripheral weld between the strike plate 252 and the body 202. Accordingly, the plate interface is formed along at least the portion or portions of the periphery of the face opening 225 that will be welded to the strike plate 252. The plate interface can include a rim and a ledge. The rim defines a surface that faces an interior of the body 202 and the ledge defines a surface that faces the front of the body 202. The rim is transverse relative to the ledge and sized to be substantially flush against or just off of the outer peripheral edge of the strike plate 252. The fit between the rim of the plate interface and the outer peripheral edge of the strike plate 252 facilitates the butt welding together of the rim and the outer peripheral edge of the strike plate 252 with the peripheral weld.

The peripheral weld is formed using any of various welding techniques, such as those disclosed in U.S. Pat. No. 8,353,785, which is incorporated herein by reference in its entirety. Moreover, the characteristics and type (e.g., bead, groove, fillet, surface, tack, plug, slot, friction, and resistance welds) of the peripheral weld can be that same or analogous to those described in U.S. Pat. No. 8,353,785. For example, in one implementation, the peripheral weld is formed using one or more of a tungsten inert gas (TIG) or metal inert gas (MIG) welding technique. In other implementations, the peripheral weld is formed using one or more of a laser welding technique or a plasma welding technique.

Figure 15:
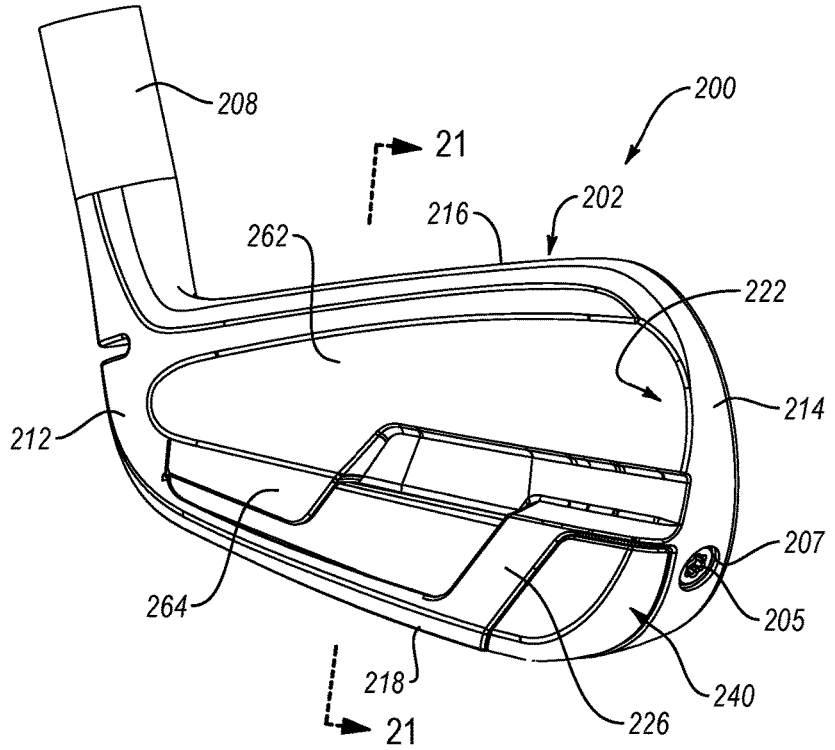
FIG. 15 is a perspective view of the golf club head of FIG. 13, from a rear of the golf club head, according to one or more examples of the present disclosure.

Referring to FIG. 15, the rear portion 222 of the golf club head 200 includes a rear wall 262 that encloses the internal cavity 232. Unlike the rear panel 160 of the golf club head 100, which is separately formed and attached to the rear portion 222 of the body 202 of the golf club head 200, the rear wall 262 is co-formed with the rear portion 222 to form a one-piece, seamless, and unitary monolithic construction with the rear portion 222. Moreover, the rear wall 262 is co-formed with the sole portion 218, the top portion 216, the toe portion 114, the heel portion 112, and the part of the front portion 120 excluding the strike plate 252 to form a one-piece, seamless, and unitary monolithic construction with these portions of the body 202. Like the golf club head 100, the rear portion 222 of the body 202 of the golf club head 200 includes an insert shelf 234, a retention bar 226, and a retention flap 264. However, unlike the golf club head 100, the insert shelf 234, the retention bar 226, and the retention flap 264 are co-formed together to form a one-piece, seamless, and unitary monolithic construction. Moreover, the insert shelf 234, the retention bar 226, and the retention flap 264 are co-formed with the rear wall 262 to form a one-piece, seamless, and unitary monolithic construction with the rear wall 262. Accordingly, the insert shelf 234, the retention bar 226, and the retention flap 264 are co-formed with the heel portion 212, the toe portion 214, the sole portion 218, and the top portion 216 to form a one-piece, seamless, and unitary monolithic construction with these portions of the body 202.

The insert shelf 234, the retention bar 226, and the retention flap 264 help to retain a high-density insert 240 of the golf club head 200 to the body 202 in the same manner as the insert shelf 134, the retention bar 126, and the retention flap 164 of the golf club head 100. For example, the retention bar 226 circumferentially closes a portion of the insert shelf 234 to define a first insert channel 228 of the rear portion 222. Additionally, the retention flap 264 is spaced apart from the retention bar 226 and the insert shelf 234 and at least partially circumferentially closes a portion of the insert shelf 234 to define a second insert channel 266 (see, e.g., FIG. 16). The high-density insert 240 is retained within the first insert channel 228 by the retention flap 264 and retained within the second insert channel 266 by the retention flap 264. The high-density insert 240 has the same size, shape, and features, relative to the rear portion 222, as the high-density insert 140 relative to the rear portion 122. Moreover, the high-density insert 240 is inserted into and adhered to the insert shelf 234, the retention bar 226, and the retention flap 264 in the same manner as the golf club head 100.

Figure 16:
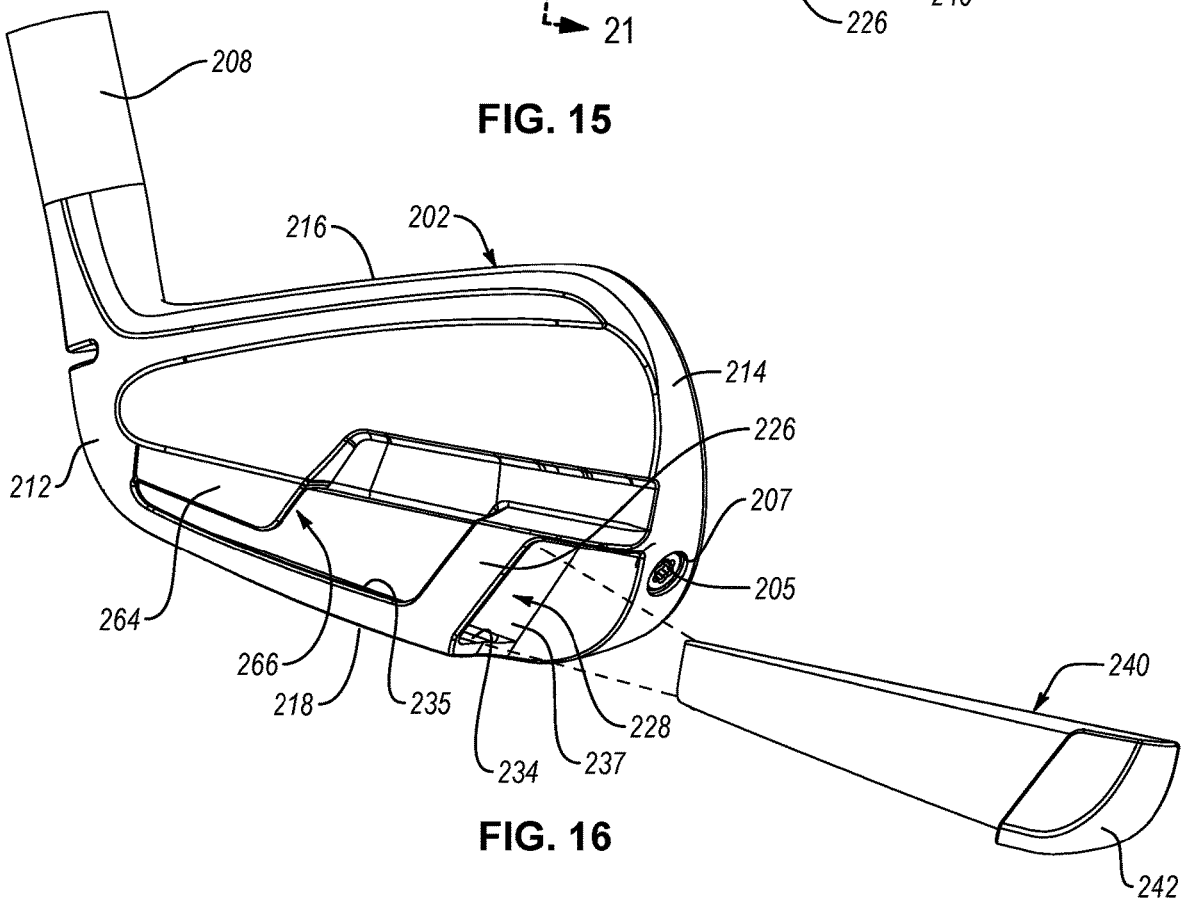
FIG. 16 is an exploded perspective view of the golf club head of FIG. 13, from a rear of the golf club head, according to one or more examples of the present disclosure.
Figure 17:
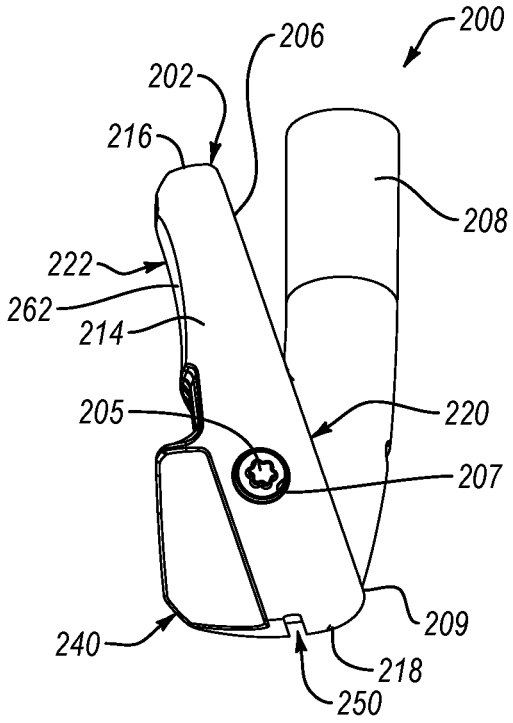
FIG. 17 is a side view of the golf club head of FIG. 13, according to one or more examples of the present disclosure.
Figure 18:
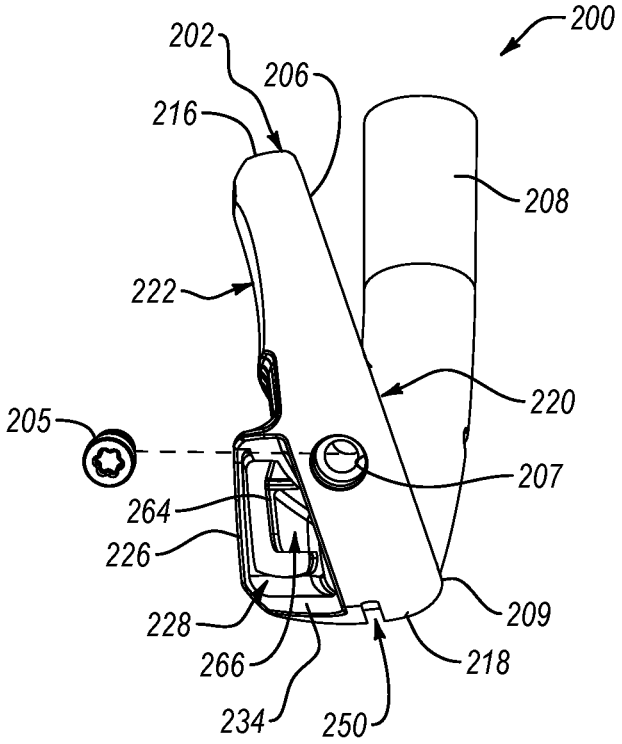
FIG. 18 is an exploded side view of the golf club head of FIG. 13, shown with a high-density insert removed, according to one or more examples of the present disclosure.
Figure 19:
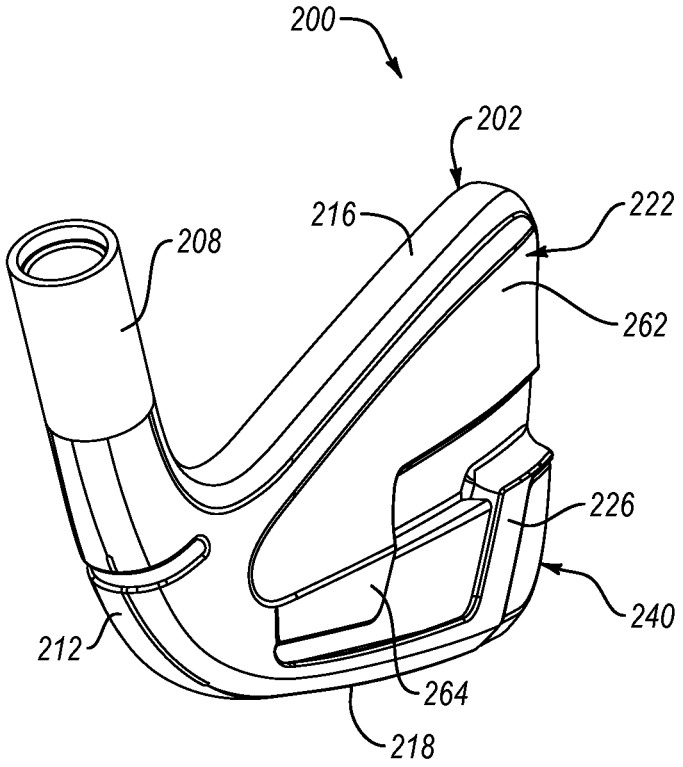
FIG. 19 is a perspective view of the golf club head of FIG. 13, from a rear of the golf club head, according to one or more examples of the present disclosure.
Figure 20:
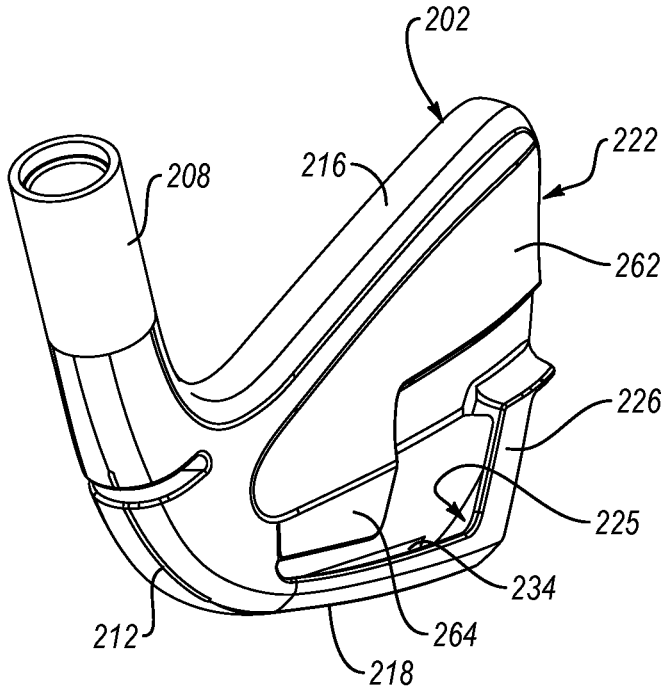
FIG. 20 is a perspective view of the golf club head of FIG. 13, from a rear of the golf club head and shown with a high-density insert removed, according to one or more examples of the present disclosure.

According to some examples, as shown in FIG. 16, the rear portion 222 also includes a front ridge 237 and a rear ridge 235, that extends along a front portion of the insert shelf 234 and a rear portion of the insert shelf 234, respectively, to at least partially constrain forward movement and rearward movement, respectively, of the high-density insert 240 relative to the body 202. Accordingly, the insert shelf 234 is interposed between the front ridge 237 and the rear ridge 235.

Figure 21:
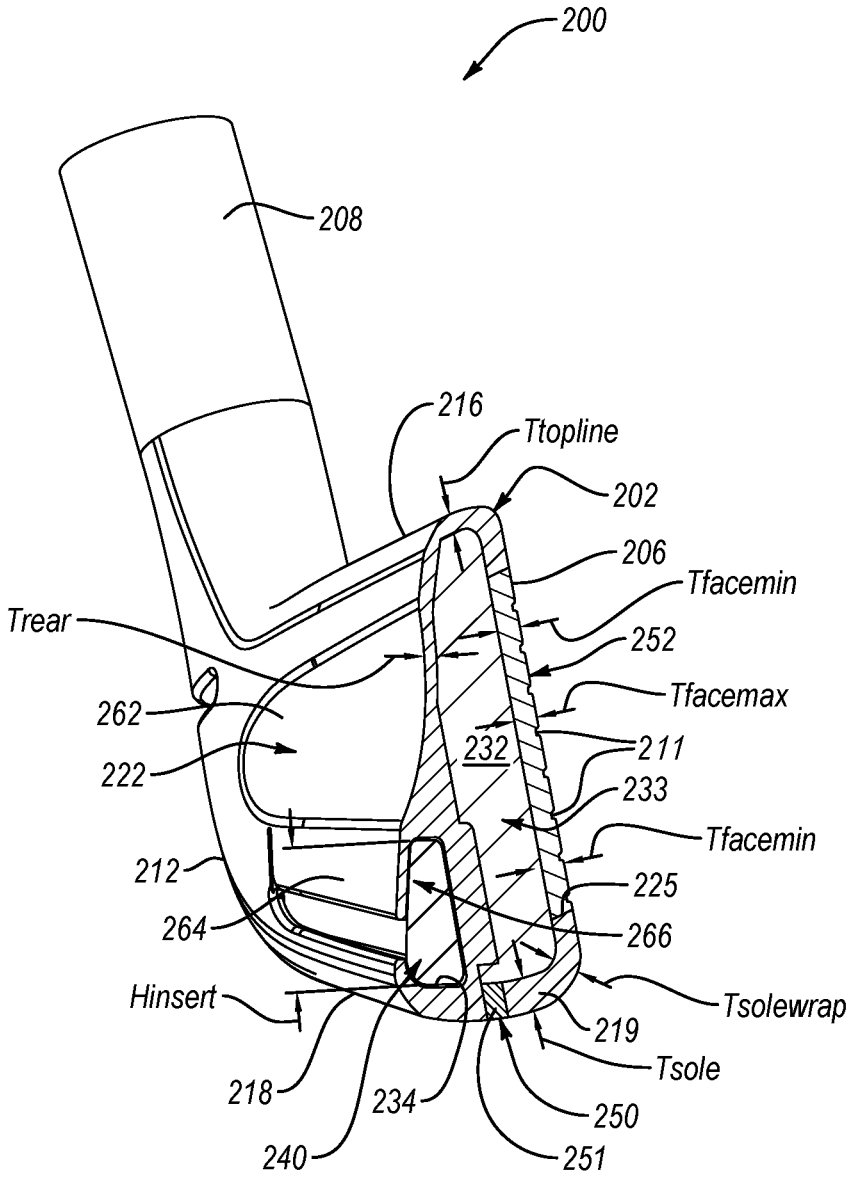
FIG. 21 is a cross-sectional perspective view of the golf club head of FIG. 13, taken along the line 21-21 of FIG. 15, according to one or more examples of the present disclosure.
Figure 22:
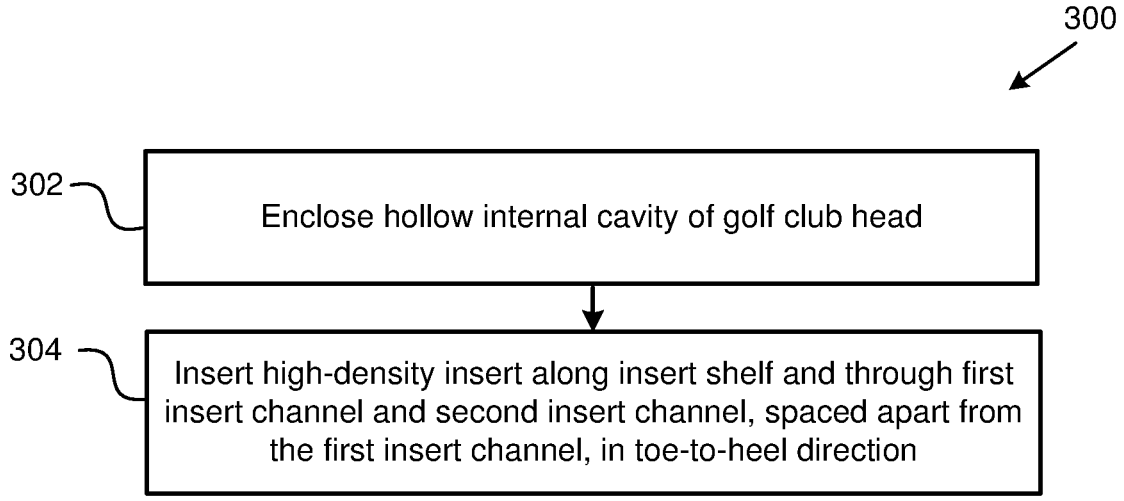
FIG. 22 is a schematic flow diagram of a method of making an iron-type golf club head, according to one or more examples of the present disclosure.

In certain examples of the golf club head 200, as shown in FIG. 21, the internal cavity 232 is partially or entirely filled with a filler material 233. In some implementations, the filler material 233 is made from a material the same as or similar to the material of the filler material 133. In other implementations, the internal cavity 132 is not filled with a filler material 233, but rather maintains an open, vacant, cavity within the golf club head 200. The filler material 233 can have the same minor impact on the COR of the golf club head 200 as the golf club head 100. Accordingly, the COR change values of Table 1 are equally applicable to the golf club head 200.

According to some examples, the filler material 233 is initially a viscous material that is injected or otherwise inserted into the club head through an injection port 207 (see, e.g., FIG. 18) located on the toe portion 214 of the golf club head 200. However, in other examples, the injection port 207 can be located anywhere on the golf club head 200. The injection port 207 can be sealed with a plug 205 after the filler material 233 is injected into the internal cavity 232.

In certain examples, the golf club head 100 and/or the golf club head 200 are configured to facilitate tuning of the characteristic time (CT) of the golf club heads after production of the golf club heads, as shown and described in U.S. Provisional Patent Application No. 62/846,492, filed May 10, 2019, which is incorporated herein by reference in its entirety. For example, the filler material in the internal cavity of the golf club heads can be the same as or similar to those disclosed in U.S. Provisional Patent Application No. 62/846,492.

The golf club head 100 and the golf club head 200, having a hollow internal cavity, provides several advantages, such as an increased forgiveness for off-center hits on the strike face. In some examples, the volume of the one or both of the golf club head 100 and the golf club head 200 is between about 10 $cm^3$ and about 120 $cm^3$. For example, in some examples, one or both of the golf club head 100 and the golf club head 200 has a volume between about 20 $cm^3$ and about 110 $cm^3$, such as between about 30 $cm^3$ and about 100 $cm^3$, such as between about 40 $cm^3$ and about 90 $cm^3$, such as between about 50 $cm^3$ and about 80 $cm^3$, and such as between about 60 $cm^3$ and about 80 $cm^3$. In addition, in some examples, one or both of the golf club head 100 and the golf club head 200 has an overall depth that is between about 15 mm and about 100 mm. For example, in some examples, one or both of the golf club head 100 and the golf club head 200 has an overall depth between about 20 mm and about 90 mm, such as between about 30 mm and about 80 mm and such as between about 40 mm and about 70 mm.

Although the golf club head 100 and the golf club head 200 have a hollow-body construction, in some examples, the features and advantages of the present disclosure can be applied equally to iron-type golf club heads having non-hollow constructions, such as muscle back iron heads, cavity back iron heads, and blade iron heads.

Referring to FIGS. 12 and 21, the thicknesses of various portions of the golf club head 100 and the golf club head 200 are shown. The identified thicknesses and the corresponding values of the identified thicknesses, provided below, are the same for both the golf club head 100 and the golf club head 200 in certain examples. Each of the golf club head 100 and the golf club head 200 has a topline thickness $T_{topline}$, a face minimum thickness $T_{facemin}$, a face maximum thickness $T_{facemax}$, a sole wrap thickness $T_{solewrap}$, a sole thickness $T_{sole}$, and a rear thickness $T_{rear}$. The topline thickness $T_{topline}$ is the minimum thickness of the wall of the body defining the top portion of the body of the golf club head. The face minimum thickness $T_{facemin}$ is the minimum thickness of the wall or plate of the body defining the face portion of the body of the golf club head. In contrast, the face maximum thickness $T_{facemax}$ is the maximum thickness of the wall or plate of the body defining the face portion of the body of the golf club head. The sole wrap thickness $T_{solewrap}$ is the minimum thickness of the wall of the body defining the transition between the face portion and the sole portion of the body of the golf club head. The sole thickness $T_{sole}$ is the minimum thickness of the wall of the body defining the sole portion of the body of the golf club head. The rear thickness $T_{rear}$ is the minimum thickness of the wall of the body defining the rear portion of the body or the rear panel of the golf club head. Additionally, each of the golf club head 100 and the golf club head 200 has an insert height $H_{insert}$, which is the distance in a direction perpendicular to a ground plane between the ground plane and an uppermost portion of the high-density insert of the golf club head when the golf club head is in proper address position on the ground plane.

According to some examples, the topline thickness $T_{topline}$ is between 1 mm and 3 mm, inclusive (e.g., between 1.4 mm and 1.8 mm, inclusive), the face minimum thickness $T_{facemin}$ is between 2.1 mm and 2.4 mm, inclusive, the face maximum thickness $T_{facemax}$ is between 3.1 mm and 4.0 mm, inclusive, the sole wrap thickness $T_{solewrap}$ is between 1.2 and 3.3 mm, inclusive (e.g., between 1.5 mm and 2.8 mm, inclusive), the sole thickness $T_{sole}$ is between 1.2 mm and 3.3 mm, inclusive (e.g., between 1.7 mm and 2.75 mm, inclusive), and/or the rear thickness $T_{rear}$ is between 1 mm and 3 mm, inclusive (e.g., between 1.2 mm and 1.8 mm, inclusive). In certain examples, a ratio of the sole wrap thickness $T_{solewrap}$ to the face maximum thickness $T_{facemax}$ is between 0.40 and 0.75, inclusive, a ratio of the sole wrap thickness $T_{solewrap}$ to the face maximum thickness $T_{facemax}$ is between 0.4 and 0.75, inclusive (e.g., between 0.44 and 0.64, inclusive, or between 0.49 and 0.62, inclusive), a ratio of the topline thickness $T_{topline}$ to the face maximum thickness $T_{facemax}$ is between 0.4 and 1.0, inclusive (e.g., between 0.44 and 0.64, inclusive, or between 0.49 and 0.62, inclusive), and/or a ratio of the sole wrap thickness $T_{solewrap}$ to the insert height $H_{insert}$ is between 0.05 and 0.21, inclusive (e.g., between 0.07 and 0.15, inclusive).

Referring now to FIG. 21, according to one example, a method 300 of making a golf club head, such as the golf club head 100, includes (block 302) enclosing the internal cavity 132 of the golf club head 100. The method 300 additionally includes (block 304) after enclosing the internal cavity 132, which is hollow, inserting (e.g., sliding) the high-density insert 140 along the insert shelf 134 and through the first insert channel 128 and the second insert channel 166 in a toe-to-heel direction. The insert shelf 134, the first insert channel 128, and the second insert channel 166 are external to the internal cavity 132. In certain implementations, the length of the high-density insert 140 is parallel to the toe-to-heel direction as the high-density insert 140 is inserted in the toe-to-heel direction along the insert shelf 134 and through the first insert channel 128 and the second insert channel 166. Accordingly, the body 102 is approached by the high-density insert 140 from the toe portion 114 and inserted into retainment with the body 102 from the toe portion 114.

According to some examples, the golf club head 100 and/or the golf club head 200 includes features or is made from processes described in one or more of U.S. Pat. No. 8,535,177, issued Sep. 17, 2013; U.S. Pat. No. 8,845,450, issued Sep. 20, 2014; U.S. Pat. No. 8,328,663, issued Dec. 11, 2012; U.S. patent application Ser. No. 14/565,057, filed Dec. 9, 2014; U.S. Pat. No. 9,975,018, issued May 22, 2018; U.S. Pat. No. 9,044,653, issued Jun. 2, 2015; U.S. Pat. No. 9,033,819, issued May 19, 2015; U.S. Pat. No. 6,811,496, issued Nov. 2, 2004; U.S. patent application Ser. No. 15/649,508, filed Jul. 13, 2017; U.S. patent application Ser. No. 15/859,274 filed Dec. 29, 2017; U.S. patent application Ser. No. 15/394,549, filed Dec. 29, 2016; U.S. patent application Ser. No. 15/706,632, filed Sep. 15, 2017; U.S. patent application Ser. No. 16/059,801, filed Aug. 9, 2018; U.S. patent application Ser. No. 16/161,337, filed Oct. 16, 2018; U.S. patent application Ser. No. 16/434,162, filed Jun. 6, 2019; U.S. patent application Ser. No. 15/681,678, filed Aug. 21, 2017; U.S. Pat. No. 8,088,025, issued Jan. 3, 2012; U.S. Pat. No. 10,155,143, issued Dec. 18, 2018; U.S. Pat. No. 9,731,176, issued Aug. 15, 2017, which are all incorporated herein by reference in their entirety.

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some examples, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A club head for an iron-type golf club, the club head comprising:

a unitary cast body comprising a heel portion, a toe portion, a top portion, a rear portion, a front portion, and a sole portion, wherein the rear portion comprises a lip and a rear opening; and a rear panel received, at least in part, by the lip of the rear portion, wherein the rear panel is configured to close the rear opening of the rear portion and to enclose an internal cavity of the club head;

wherein:

the internal cavity of the club head is defined by a region enclosed by the heel portion, the toe portion, the sole portion, the top portion, the front portion, the rear portion, and the rear panel;

the lip is recessed relative to adjacent surfaces of the rear portion and is configured to receive the rear panel in a seated engagement;

the front portion comprises a strike face, co-formed with the unitary cast body, and an interior surface, opposite the strike face;

the interior surface of the front portion includes a variable thickness projection that projects rearwardly;

no portion of the rear panel directly contacts the strike face;

the rear panel is separately formed from and coupled to the lip of the rear portion of the unitary cast body; and the internal cavity is at least partially filled with a non-metal filler material.

2. The club head of claim 1, wherein:

the unitary cast body is made of a first material having a density less than 8 g/cc; and the rear panel has a density greater than 1 g/cc and no more than the density of the first material.

3. The club head of claim 1, wherein the non-metal filler material comprises a foam filler material injected into the internal cavity through an injection port on the club head.

4. The club head of claim 1, wherein:

the rear panel comprises a base having an outer periphery corresponding to a size and shape of the lip; and the base has an interior surface configured to seat against a surface of the lip.

5. The club head of claim 1, wherein:

the rear panel has a variable thickness; and a first thickness of the rear panel, proximate the top portion, is less than a second thickness of the rear panel, proximate the sole portion.

6. The club head of claim 5, wherein the first thickness is no more than 3 mm.

7. The club head of claim 1, further comprising an elongated insert extending in a substantially heel-to-toe direction and having a heelward end and a toeward end, which is opposite the heelward end, wherein the heelward end is in the heel portion of the body and the toeward end is in the toe portion of the body.

8. The club head of claim 7, wherein the insert is asymmetric along a length of the insert and a mass of the insert at the toeward end of the insert is greater than at a heelward end of the insert.

9. The club head of claim 7, wherein the insert tapers from the toeward end to the heelward end such that the toeward end of the insert is larger than the heelward end.

10. The club head of claim 7, wherein the club head has a coefficient of restitution (COR) change value of between −0.00001 and −0.025, the COR change value being defined as a difference between a measured COR value of the club head and a United States Golf Association (USGA)-governed calibration plate COR value.

11. The club head of claim 7, wherein a perimeter of the insert at the toeward end of the insert is greater than at the heelward end of the insert.

12. The club head of claim 7, wherein the insert is positioned closer to the sole portion than the top portion and a majority of the insert is positioned below a center of gravity of the club head.

13. The club head of claim 7, wherein:

the rear opening has a plurality of sides, comprising at least an upper side and a lower side; and at least a portion of the insert is positioned toeward of the lower side.

14. The club head of claim 7, wherein:

the rear opening has a plurality of sides, comprising at least a lowermost side;

the lowermost side has a lowermost side length defined between a heel end of the lowermost side to a toe end of the lowermost side; and an overall length of the insert is greater than the lowermost side length of the lowermost side of the rear opening.

15. The club head of claim 1, wherein the lip continuously surrounds the rear opening of the rear portion.

16. The club head of claim 1, wherein the variable thickness projection is shifted toeward of a center gravity of the club head.

17. A club head for an iron-type golf club, the club head comprising:

a unitary cast body comprising a heel portion, a toe portion, a top portion, a rear portion, a front portion, and a sole portion, wherein the rear portion comprises a lip and a rear opening; and a rear panel received, at least in part, by the lip of the rear portion, wherein the rear panel is configured to close the rear opening of the rear portion and to enclose an internal cavity of the club head;

wherein:

the internal cavity of the club head is defined by a region enclosed by the heel portion, the toe portion, the sole portion, the top portion, the front portion, the rear portion, and the rear panel;

the lip is recessed relative to adjacent surfaces of the rear portion and is configured to receive the rear panel in a seated engagement;

the front portion comprises a strike face, co-formed with the unitary cast body, and an interior surface, opposite the strike face;

the interior surface of the front portion includes a variable thickness projection that projects rearwardly;

no portion of the rear panel directly contacts the strike face;

the rear panel is separately formed from and coupled to the lip of the rear portion of the unitary cast body; and the club head has a face minimum thickness ($T_{facemin}$), a face maximum thickness ($T_{facemax}$), a sole wrap thickness ($T_{solewrap}$), a topline thickness ($T_{topline}$), a sole thickness $T_{sole}$, and a ratio of the sole wrap thickness $T_{solewrap}$ to the face maximum thickness $T_{facemax}$ is between 0.40 and 0.75.

18. The club head of claim 17, wherein the face maximum thickness ($T_{facemax}$) is no more than 3.5 mm.

19. A club head for an iron-type golf club, the club head comprising:

a unitary cast body comprising a heel portion, a toe portion, a top portion, a rear portion, a front portion, and a sole portion, wherein the rear portion comprises a lip and a rear opening; and a rear panel received, at least in part, by the lip of the rear portion, wherein the rear panel is configured to close the rear opening of the rear portion and to enclose an internal cavity of the club head;

wherein:

the internal cavity of the club head is defined by a region enclosed by the heel portion, the toe portion, the sole portion, the top portion, the front portion, the rear portion, and the rear panel;

the lip is recessed relative to adjacent surfaces of the rear portion and is configured to receive the rear panel in a seated engagement;

the front portion comprises a strike face, co-formed with the unitary cast body, and an interior surface, opposite the strike face;

the interior surface of the front portion includes a variable thickness projection that projects rearwardly;

no portion of the rear panel directly contacts the strike face;

the rear panel is separately formed from and coupled to the lip of the rear portion of the unitary cast body;

the rear panel has a plurality of sides, comprising:

an upper side that extends upward and toeward, parallel with the top portion of the unitary cast body, from a heelward end of the rear panel towards a toeward end of the rear panel;

a lower side; and at least two toe sides, extending between the upper side and the lower side; and at least one of the at least two toe sides extends upward and toeward.

* * * * *